US012611084B2

(12) United States Patent
Lee et al.

(10) Patent No.: US 12,611,084 B2
(45) Date of Patent: Apr. 28, 2026

(54) DISH WASHER

(71) Applicant: LG Electronics Inc., Seoul (KR)

(72) Inventors: Minhyuk Lee, Seoul (KR); Sung Hun Lee, Seoul (KR); Daegyu Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 115 days.

(21) Appl. No.: 18/543,724

(22) Filed: Dec. 18, 2023

(65) Prior Publication Data

US 2024/0197144 A1 Jun. 20, 2024

(30) Foreign Application Priority Data

Dec. 20, 2022 (KR) ..... 10-2022-0179506

(51) Int. Cl.
*A47L 15/44* (2006.01)

(52) U.S. Cl.
CPC ..... *A47L 15/449* (2013.01); *A47L 15/4418* (2013.01)

(58) Field of Classification Search
None
See application file for complete search history.

(56) References Cited

U.S. PATENT DOCUMENTS

2015/0300348 A1* 10/2015 Bach ..... F04B 43/1261 417/32
2016/0143503 A1 5/2016 Kan et al.

FOREIGN PATENT DOCUMENTS

EP 2740829 A1 6/2014
JP 2021/132978 A 9/2021
WO WO 2021/245620 A1 12/2021

OTHER PUBLICATIONS

JP_2021132978 translation (Year: 2021).*
Extended European Search Report in European Appln No. 23218176.8, mailed on May 17, 2024, 9 pages.

* cited by examiner

*Primary Examiner* — Rita P Adhlakha
(74) *Attorney, Agent, or Firm* — Fish & Richardson P.C.

(57) ABSTRACT

A dish washer senses an amount of change in a level of a detergent via a floater that moves in a vertical direction based on the level of the detergent and a detergent level sensor that senses a location in the vertical direction of the floater, and effectively identifies a viscosity of the detergent stored in a detergent supply based on the amount of change in the level to simplify a structure, improve space utilization, and reduce a manufacturing cost by eliminating a separate electrode sensor or level sensor to identify the viscosity of the detergent.

12 Claims, 18 Drawing Sheets

DISH WASHER

CROSS-REFERENCE TO RELATED APPLICATION

This application claims priority to and benefit of Korean Patent Application No. 10-2022-0179506, filed on Dec. 20, 2022, which is hereby incorporated by reference as when fully set forth herein.

TECHNICAL FIELD

The present disclosure relates to a dish washer, and more specifically, to a dish washer that may sense an amount of change in a level of a detergent via a floater that moves in a vertical direction based on the level of the detergent and a detergent level sensor that senses a location of the floater in the vertical direction, and effectively identify a viscosity of the detergent stored in a detergent supply, wherein a separate electrode sensor or level sensor to identify the viscosity of the detergent may be eliminated, so that a structure may be simplified, space utilization may be improved, and a manufacturing cost may be reduced.

BACKGROUND

A dish washer is an apparatus that washes a dish, a cooking utensil, and the like, which are objects-to-be-washed stored therein, by spraying washing water, such as water, thereto. In this regard, the washing water used for the washing may contain a detergent.

The dish washer generally includes a tub that defines a washing space therein, a storage that accommodates the objects-to-be-washed inside the tub, a spray arm that sprays the washing water into the storage, and a sump that stores water therein and supplies the washing water into the spray arm.

As such dish washer is used, time and effort required to wash the objects-to-be-washed such as the dish after a meal may be reduced, contributing to user convenience.

The detergent used for the washing may be supplied into the tub via a detergent supply. The detergent supplied into the tub may be mixed with water to create the washing water.

In general, the detergent supply may be composed of a container that stores the detergent therein, and a detergent pump that pumps the detergent stored in the container into the tub.

In relation, in International Patent Application Publication No. 2021-245620 (Prior art literature 001), disclosed is a dish washer that supplies a detergent via a tube pump-type dispenser, wherein the dish washer has the dispenser that allows a user to select a washing process mode suitable for a viscosity or viscosity characteristics of the detergent by placing a separate electrode sensor or level sensor for sensing the viscosity or the viscosity characteristics of the detergent inside the dispenser.

However, the structure disclosed in prior art literature 001 requires the separate electrode sensor for sensing the viscosity of the detergent inside the dispenser, which worsens space utilization, makes the structure complicated to a certain extent, and significantly increases a manufacturing cost.

(Patent Document 001) International Patent Application Publication No. 2021-245620

SUMMARY

The present disclosure was designed to solve the problems of the prior art described above, and has a first purpose of providing a dish washer that senses an amount of change in a level of a detergent via a floater that moves in a vertical direction based on the level of the detergent and a detergent level sensor that senses a location in the vertical direction of the floater, and effectively identifies a viscosity of the detergent stored in a detergent supply based on the amount of change in the level to simplify a structure, improve space utilization, and reduce a manufacturing cost by eliminating a need for a separate electrode sensor or level sensor to identify the viscosity of the detergent.

In addition, the present disclosure has a second purpose of providing a dish washer that automatically selects a washing process mode suitable for a viscosity of a detergent to improve user convenience.

In addition, the present disclosure has a third purpose of providing a dish washer that, when a viscosity of a stored detergent is high enough to be unsuitable for a detergent pump, stops operation of the detergent pump and instructs a user to replace the detergent with a suitable detergent to effectively prevent damage to the detergent pump.

Purposes of the present disclosure are not limited to the above-mentioned purpose. Other purposes and advantages of the present disclosure that are not mentioned may be understood based on following descriptions, and may be more clearly understood based on embodiments of the present disclosure. Further, it will be easily understood that the purposes and advantages of the present disclosure may be realized using means shown in the claims and combinations thereof.

A first aspect of the present disclosure provides a dish washer including a tub having a washing space defined therein, a detergent supply including a container that stores therein a detergent to be provided to the washing space, and a detergent pump that supplies the detergent stored in the container to the washing space, and a controller that controls operation of the detergent pump, wherein the container includes a floater disposed inside the container and movable along a vertical direction corresponding to a level of the detergent, and a detergent level sensor that senses a location in the vertical direction of the floater and generates an output signal corresponding to the location in the vertical direction of the floater, wherein the controller calculates an amount of change in the level by sensing the level of the detergent changing based on the operation of the detergent pump via the detergent level sensor, and determines a viscosity of the detergent based on the calculated amount of change in the level.

In one implementation of the first aspect, the determining of the viscosity of the detergent may include receiving the output signal from the detergent level sensor, detecting an initial location of the floater based on the received output signal, operating the detergent pump to supply a preset supply amount of detergent to the tub when the initial location of the floater is detected, re-receiving the output signal from the level sensor when the supply of the detergent of the preset supply amount is completed, detecting a current location of the floater based on the re-received output signal and calculating the amount of change in the level of the detergent, and detecting the viscosity of the detergent based on the amount of change in the level of the detergent.

In one implementation of the first aspect, the detergent pump may include a tube that guides the detergent discharged from the container to the washing space, a roller that pressurizes the tube and revolves around a revolution axis to allow the detergent inside the tube to flow, a pump motor that generates a driving force to move the roller, and a roller sensor that senses a location of the roller and generates an output signal corresponding to the location of the roller, and the supplying of the preset supply amount of detergent to the tub may include calculating the number of revolutions of the roller based on the output signal of the roller sensor, and determining that the supply of the preset supply amount of the detergent has been completed when it is determined that the number of revolutions has reached a set number.

In one implementation of the first aspect, the amount of change in the level of the detergent may be calculated by calculating a difference between the initial location of the floater and the current location of the floater.

In one implementation of the first aspect, the detecting of the viscosity of the detergent may include calling data converting the amount of change in the level into the viscosity from a memory, and determining the viscosity corresponding to the calculated amount of change in the level via data on the viscosity compared to the called amount of change in the level.

In one implementation of the first aspect, the controller may further determine a mode of a washing process suitable for the viscosity of the detergent or generate a detergent replacement alarm based on the determined viscosity of the detergent.

In one implementation of the first aspect, the determining of the mode of the washing process suitable for the viscosity of the detergent or the generating of the detergent replacement alarm may include determining whether the determined viscosity of the detergent is low, medium, or high.

In one implementation of the first aspect, the determining of the mode of the washing process suitable for the viscosity of the detergent or the generating of the detergent replacement alarm may further include determining the mode of the washing process to be a normal mode when it is determined that the viscosity of the detergent is low.

In one implementation of the first aspect, the determining of the mode of the washing process suitable for the viscosity of the detergent or the generating of the detergent replacement alarm may further include determining the mode of the washing process to be a soft mode when it is determined that the viscosity of the detergent is medium.

In one implementation of the first aspect, the determining of the mode of the washing process suitable for the viscosity of the detergent or the generating of the detergent replacement alarm may further include generating a visual alarm via a display or an acoustic alarm via a sound outputter when it is determined that the viscosity of the detergent is high.

In one implementation of the first aspect, the visual alarm and the acoustic alarm may contain information inducing replacement of the detergent or indicating that the detergent is not suitable.

In one implementation of the first aspect, the controller may further stop the washing process when it is determined that the viscosity of the detergent is high.

A second aspect of the present disclosure provides a dish washer including a tub having a washing space defined therein, and a detergent supply including a container that stores therein a detergent to be provided to the washing space, and a detergent pump that supplies the detergent stored in the container to the washing space, wherein the container includes a floater disposed inside the container and movable along a vertical direction corresponding to a level of the detergent, and a detergent level sensor that senses a location in the vertical direction of the floater, wherein a magnetic body emitting a predetermined magnetic force is disposed inside the floater, wherein the detergent level sensor generates an output signal corresponding to an intensity of the magnetic force emitted from the magnetic body.

In one implementation of the second aspect, a hollow may be defined inside the floater, and the magnetic body may be disposed in the hollow.

In one implementation of the second aspect, the detergent level sensor may have a sensing surface that senses the magnetic force emitted from the magnetic body and is disposed below the magnetic body, and when the floater is moved downwards along the movement direction, an overlapping area may be generated between the sensing surface and the magnetic body.

In one implementation of the second aspect, a stopper rib and a guide bar for limiting a range of movement of the floater in the vertical direction may be disposed inside the container.

In one implementation of the second aspect, the stopper rib may be a barrier-shaped rib integrally connected to an inner surface of the container, and a top surface of the floater may come into contact with a lower end of the stopper rib while the floater moves based on the level of the detergent.

In one implementation of the second aspect, the guide bar may have a cone-shaped outer appearance where a lower end is integrally connected to an inner surface of the container and an upper end protrudes upwards, and a guide groove may be defined inside the floater, wherein the guide bar is inserted into the guide groove.

In one implementation of the second aspect, the guide bar may include a first guide bar and a second guide bar having different protrusion heights, and the guide groove may include a first guide groove where the first guide bar is inserted and a second guide bar where the second guide bar is inserted.

In one implementation of the second aspect, a gradient of the first guide bar and a gradient of the first guide groove may be different from each other, or a gradient of the second guide bar and a gradient of the second guide groove may be different from each other.

The dish washer according to the present disclosure may simplify the structure, improve the space utilization, and reduce the manufacturing cost as the separate electrode sensor or level sensor to identify the viscosity of the detergent may be eliminated.

In addition, the dish washer according to the present disclosure may automatically select the washing process mode suitable for the viscosity of the detergent, thereby improving the user convenience.

In addition, the dish washer according to the present disclosure may stop the operation of the detergent pump and instruct the user to replace the detergent with the suitable detergent when the viscosity of the stored detergent is high enough to be unsuitable for the detergent pump, thereby effectively preventing the damage to the detergent pump.

In addition to the above-mentioned effects, specific effects of the present disclosure will be described below while describing the specific details for carrying out the invention.

DETAILED DESCRIPTION

Figure 1:
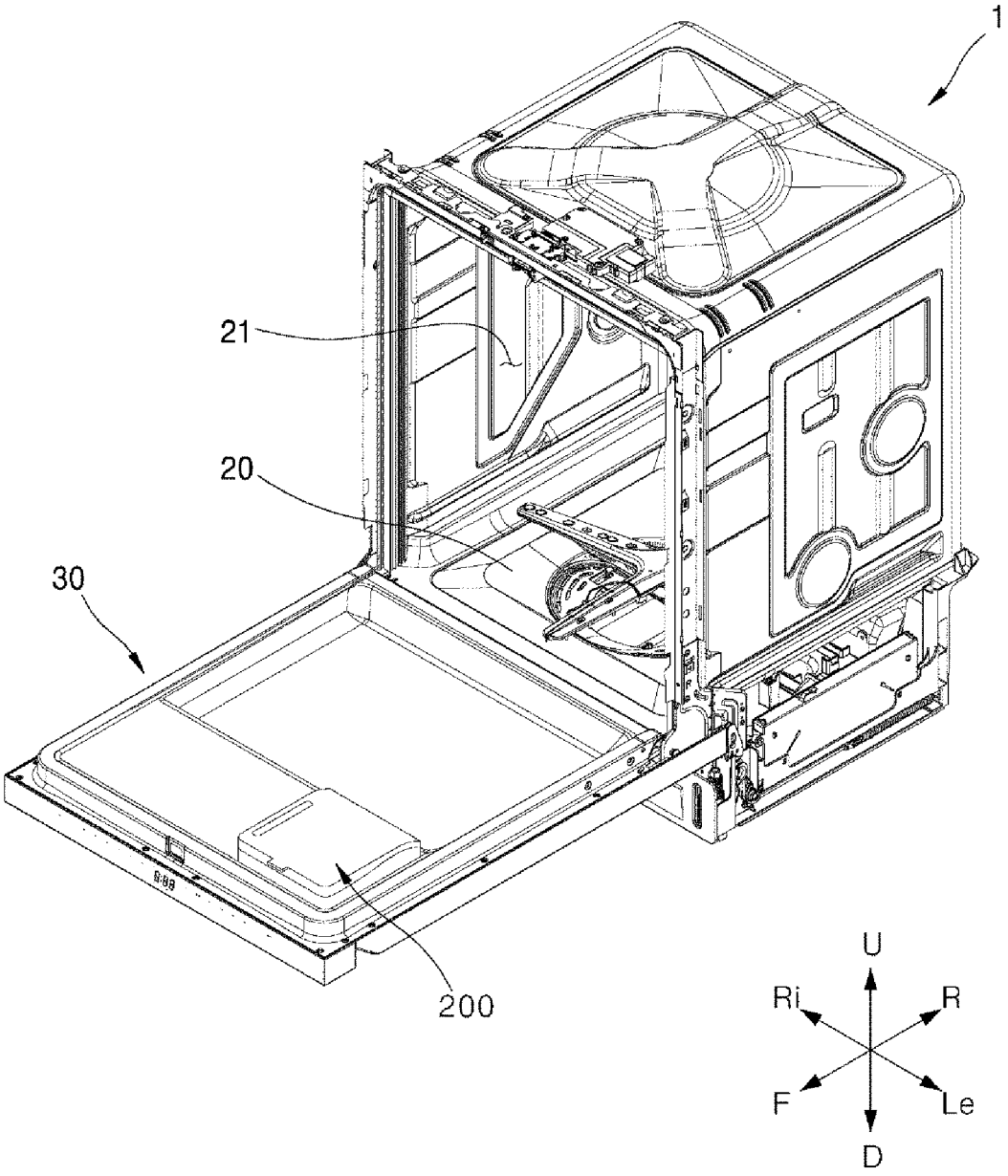
FIG. 1 is a front perspective view of a dish washer according to an embodiment of the present disclosure.

The above-mentioned purposes, features, and advantages will be described in detail later with reference to the attached drawings, so that those skilled in the art in the technical field to which the present disclosure belongs may easily implement the technical ideas of the present disclosure. In describing the present disclosure, when it is determined that a detailed description of the publicly known technology related to the present disclosure may unnecessarily obscure the gist of the present disclosure, the detailed description will be omitted. Hereinafter, a preferred embodiment according to the present disclosure will be described in detail with reference to the attached drawings. In the drawings, identical reference numerals are used to indicate identical or similar components.

Although first, second, and the like are used to describe various components, these components are not limited by such terms. Such terms are only used to distinguish one component from another component, and unless specifically stated to the contrary, a first component may also be a second component.

Throughout the present document, unless otherwise stated, each component may be singular or plural.

Hereinafter, a first component being disposed "on top of (or under)" a second component may mean that the first component may be disposed in contact with a top surface (or a bottom surface) of the second component, as well as a third component may be interposed between the second component and the first component disposed "on top of (or under)" the second component.

Furthermore, when a first component is described as being "connected" or "coupled" to a second component, the components may be directly connected or coupled to each other, but a third component may be "interposed" between the components or the components may be "connected" or "coupled" to each other via the third components.

As used herein, the singular constitutes "a" and "an" are intended to include the plural constitutes as well, unless the context clearly indicates otherwise. In this application, terms such as "composed of" or "include" should not be construed as necessarily including all of various components or steps described herein, but should be construed that some components or steps among those may not be included or additional components or steps may be further included.

As used herein, the singular constitutes "a" and "an" are intended to include the plural constitutes as well, unless the context clearly indicates otherwise. In this application, terms such as "composed of" or "include" should not be construed as necessarily including all of various components or steps described herein, but should be construed that some components or steps among those may not be included or additional components or steps may be further included.

Throughout the present document, "A and/or B" means A, B, or A and B, unless otherwise specified, and "C to D" means equal to or greater than C and equal to or smaller than D unless otherwise specified.

[Overall Structure of Dish Washer]

Hereinafter, an overall structure of a dish washer 1 according to one embodiment of the present disclosure will be described in detail with reference to attached drawings.

Figure 2:
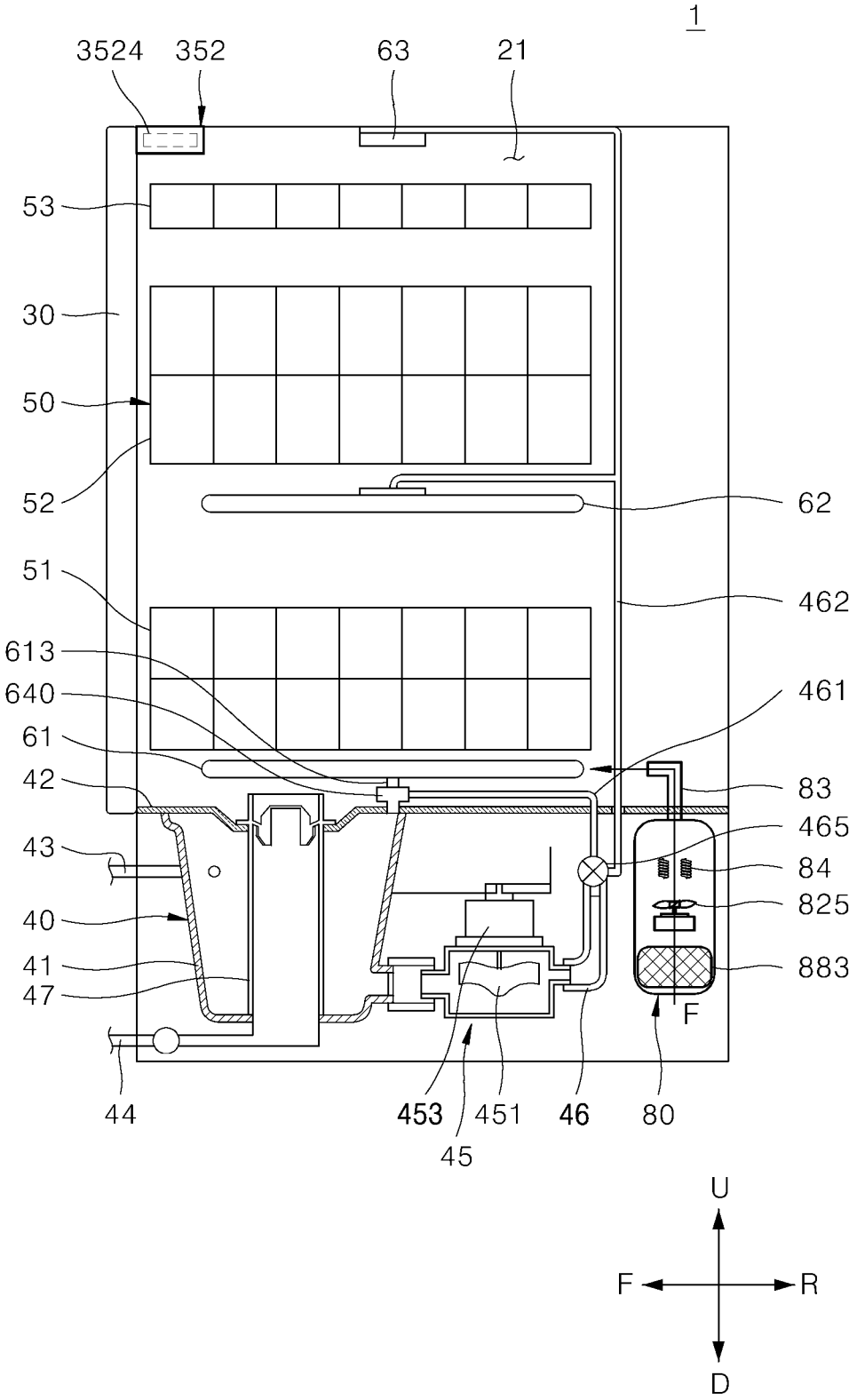
FIG. 2 is a simplified cross-sectional view of a dish washer shown in FIG. 1.

FIG. 1 is a front perspective view showing a dish washer according to the present disclosure, and FIG. 2 is a simplified cross-sectional view simply showing an internal structure of a dish washer according to the present disclosure.

As shown in FIGS. 1 and 2, the dish washer 1 according to one embodiment of the present disclosure includes a casing 10 that forms an outer appearance of the dish washer, a tub 20 that is installed inside the casing 10, defines therein a washing space 21 in which objects-to-be-washed are washed, and has an open front surface, a door 30 that opens and closes the open front surface of the tub 20, a driver 40 that is located beneath the tub 20 and supplies, collects, circulates, and drains washing water for washing the objects-to-be-washed, a storage 50 that is removably disposed in the internal washing space 21 of the tub 20 and where the objects-to-be-washed are placed, and a spray 60 that is installed adjacent to the storage 50 and sprays the washing water for washing the objects-to-be-washed.

In this regard, the objects-to-be-washed placed in the storage 50 may be, for example, dishes such as a bowl, a plate, a spoon, chopsticks, and other cooking utensils. Hereinafter, unless otherwise specified, the objects-to-be-washed will be referred to as the dishes.

The tub 20 may be formed in a box shape with the entirely open front surface, and may correspond to a component known as a so-called washing tank.

The washing space 21 may be defined inside the tub 20, and the open front surface may be opened and closed by the door 30.

The tub 20 may be formed via press processing of a metal plate resistant to high temperature and moisture, for example, a stainless steel plate.

In addition, a number of brackets for allowing functional components such as the storage 50 and the spray 60, which will be described later, to be supported and installed inside the tub 20 may be disposed on an inner surface of the tub 20.

In one example, the driver 40 may be composed of a sump 41 that stores the washing water therein, a sump cover 42 that separates the sump 41 from the tub 20, a water supply 43 that supplies the washing water to the sump 41 from the outside, a drainage 44 that drains the washing water of the sump 41 to the outside, and a water supply pump 45 and a supply passage 46 for supplying the washing water of the sump 41 to the spray 60.

The sump cover 42 may be disposed on the sump 41 and may serve to separate the tub 20 from the sump 41. Additionally, the sump cover 42 may have a plurality of recovery holes to recover the washing water sprayed into the washing space 21 via the spray 60 to the sump 41.

In other words, the washing water sprayed from the spray 60 toward the dishes may fall to a bottom of the washing space 21, pass through the sump cover 42, and be recovered back into the sump 41.

The water supply pump 45 is disposed next to or below the sump 41 and serves to pressurize the washing water and supply the washing water to the spray 60.

One end of the water supply pump 45 may be connected to the sump 41 and the other end thereof may be connected to the supply passage 46. The water supply pump 45 may have an impeller 451, a motor 453, and the like. When power is supplied to the motor 453, the impeller 451 may rotate, and the washing water in the sump 41 may be pressurized and then be supplied to the spray 60 via the supply passage 46.

In one example, the supply passage 46 may serve to selectively supply the washing water supplied from the water supply pump 45 to the spray 60.

For example, may supply passage 46 may include a first supply passage 461 connected to a lower spray arm 61, and a second supply passage 463 connected to an upper spray arm 62 and a top nozzle 63. The supply passage 46 may include a supply passage switching valve 465 that selectively opens and closes the supply passages 461 and 463.

In this regard, the supply passage switching valve 465 may be controlled such that the supply passages 461 and 463 are sequentially opened or simultaneously opened.

In one example, the spray 60 is constructed to spray the washing water to the dishes or the like stored in the storage 50.

More specifically, the spray 60 may include the lower spray arm 61 that is located at the bottom of the tub 20 and sprays the washing water to a lower rack 51, the upper spray arm 62 that is located between the lower rack 51 and the upper rack 52 and sprays the washing water to the lower rack 51 and the upper rack 52, and the top nozzle 63 that is located at a top of the tub 20 and sprays the washing water to the top rack 53 or the upper rack 52.

In particular, the lower spray arm 61 and the upper spray arm 62 may be rotatably disposed in the washing space 21 of the tub 20 to spray the washing water while rotating toward the dishes in the storage 50.

The lower spray arm 61 may be rotatably supported above the sump cover 42 so as to spray the washing water while rotating toward the lower rack 51 from below the lower rack 51.

In addition, the upper spray arm 62 may be rotatably supported by a spray arm holder 467 so as to spray the washing water while rotating between the lower rack 51 and the upper rack 52.

In one example, means for diverting the washing water sprayed from the lower spray arm 61 to an upward direction (a U-direction) may be further disposed on a bottom surface 25 of the tub 20 to increase a washing efficiency.

In one example, the washing space 21 may have the storage 50 for storing the dishes.

The storage 50 is constructed to be extendable from the inside of the tub 20 via the open front surface of the tub 20.

For example, in FIG. 2, an embodiment with the lower rack 51 that is located at the bottom of the tub 20 and accommodates relatively large dishes therein, the upper rack 52 that is located above the lower rack 51 and accommodates medium-sized dishes therein, and the top rack 53 that is located at the top of the tub 20 and accommodates small dishes therein is shown. The present disclosure is not limited thereto, but a description will be made based on the embodiment of the dish washer with the three storages 50 as shown.

Such lower rack 51, upper rack 52, and top rack 53 may be constructed to be extendable via the open front surface of the tub 20.

To this end, guide rails (not shown) may be disposed on both side walls forming inner peripheral surfaces of the tub 20. For example, the guide rail may include an upper rail, a lower rail, and a top rail.

Wheels may be disposed beneath the lower rack 51, the upper rack 52, and the top rack 53, respectively. A user may store the dishes in the lower rack 51, the upper rack 52, and the top rack 53 by extending the racks to the outside via the front surface of the tub 20, or easily pull the dishes that have been washed from the racks.

A guide rail 54 may be formed as a fixed guide rail in a form of a simple rail to guide extension and retraction of the spray 60, or a telescopic guide rail that guides the extension and the retraction of the spray 60 and increases an extension distance thereof as the spray 60 extends.

In one example, the door 30 has the purpose of opening and closing the open front surface of the tub 20 described above.

A hinge (not shown) for opening and closing the door 30 may be generally disposed at a bottom of the open front surface, and the door 30 may be opened by pivoting with the hinge as a pivoting axis.

In this regard, a handle for opening the door 30 and a control panel for controlling the dish washer 1 may be disposed on an outer surface of the door 30.

As shown, the control panel may include a display that visually displays information on a current operating state or the like of the dish washer, and a button including a selection button through which a selection manipulation of the user is input and a power button through which a manipulation of the user to turn on and off the dish washer is input.

In one example, a rear panel forming an inner surface of the door 30 may form one surface of the tub 20 when the door 30 is closed, and at the same time, may form a seating surface on which the lower rack 51 of the storage 50 may be supported when the door 30 is fully opened.

To this end, it is desirable that, when the door 30 is fully opened, the rear panel of the door 30 forms a horizontal plane in the same direction as the guide rail 54 where the lower rack 51 is guided extends.

In addition, although not shown in FIGS. 1 and 2, a detergent supply where a detergent for washing the objects-to-be-washed is stored and for automatically supplying an appropriate amount of detergent during a washing process may be disposed on the rear panel of the door 30.

The appropriate amount of detergent may be determined based on a washing load, that is, a total amount of objects-to-be-washed.

A description on detailed components of the detergent supply will be made later with reference to FIG. 3A and subsequent drawings.

In one example, as shown in FIG. 2, an automatic door opening module 352 for automatically opening the door may be disposed at an outer side of a top surface of the tub 20.

As an example, the automatic door opening module 352 may have a push rod 3524 that pivots an upper end of the rear surface of the door 30 to an open location.

In one example, a drying wind supply 80 for generating high or low temperature drying wind and supplying the drying wind to the washing space inside the tub 20 may be disposed at a lower portion of the tub 20.

As shown, the drying wind supply 80 may be composed of a filter member 883 that filters external air, a blowing fan 825 that generates a drying wind airflow, a heater 84 that heats the drying wind airflow, and an airflow guide 83 that is disposed inside the tub and guides the drying wind airflow.

A drying wind supply hole 254 may be defined in a bottom surface of the tub 20 such that high-temperature drying wind generated from the drying wind supply may be introduced into the tub 20.

[Detailed Configuration of Detergent Supply]

As described above, a detergent supply 200 disposed in the dish washer 1 according to one embodiment of the present disclosure may be disposed on and attached to the door 30.

Figure 3A:
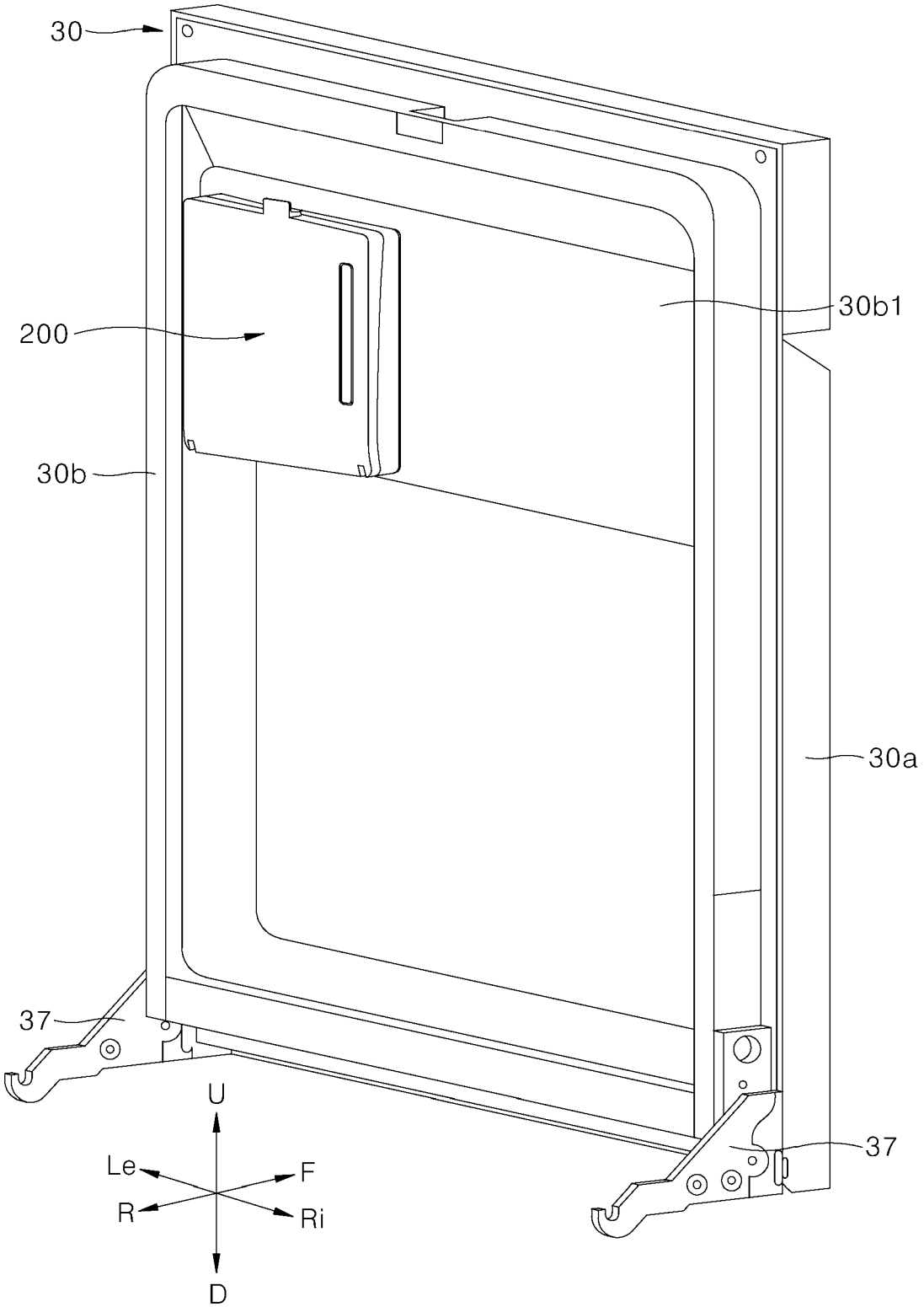
FIG. 3A is a rear perspective view showing a detergent supply according to an embodiment of the present disclosure attached to a rear panel of a door.
Figure 3B:
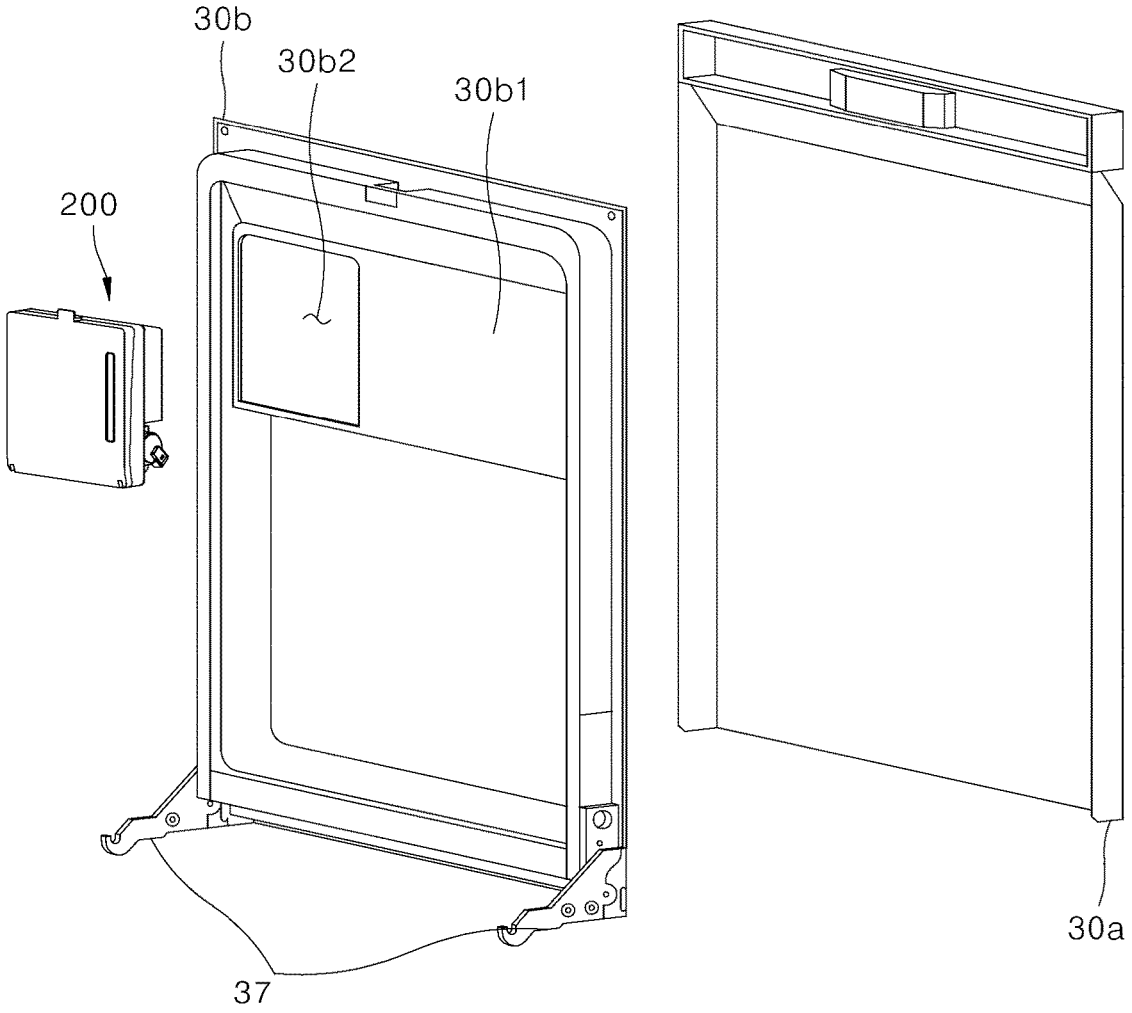
FIGS. 3B and 3C are exploded perspective views of FIG. 3A.
Figure 3C:
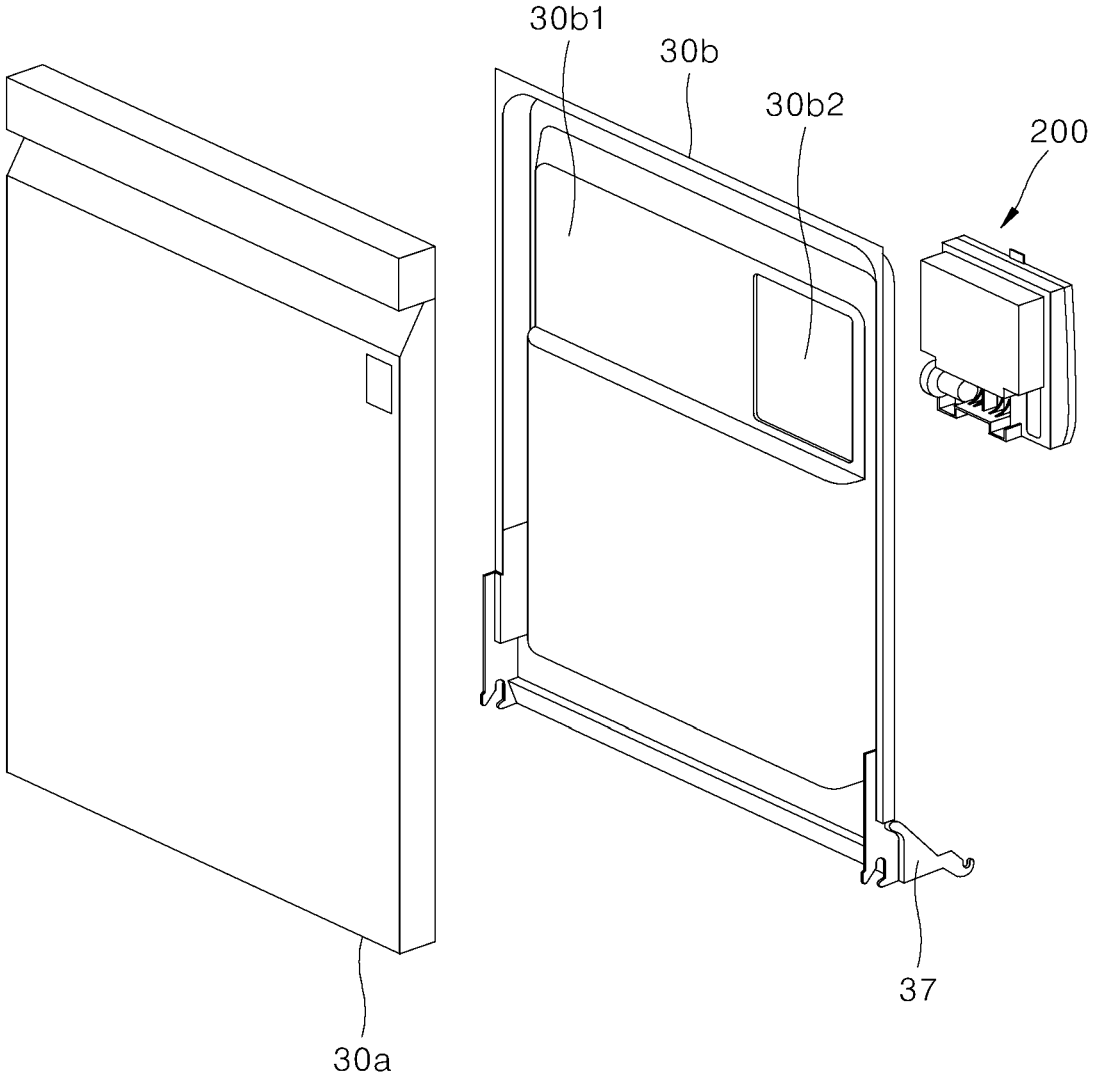

As shown in FIGS. 3A to 3C, the door 30 may include a front panel 30*a* that forms a front surface of the dish washer 1, and a rear panel 30*b* that is coupled to the front panel 30*a* and disposed to face the inside of the tub 20 to form the rear surface of the door 30.

In this regard, the detergent supply 200 may be coupled to the rear panel 30*b* that forms the rear surface of the door 30.

As shown, a concave portion that is concavely recessed toward the front panel 30*a* may be defined at a lower portion of the rear panel 30*b*, and the concave portion may not be defined at an upper portion of the rear panel 30*b*. Therefore, a rear protruding surface 30*b*1 that protrudes further rearwardly of the upper portion may be formed at the upper portion of the rear panel 30*b*.

As will be described later, because a predetermined detergent storage capacity must be secured inside the detergent supply 200, a width in a front and rear direction of the detergent supply 200 needs to be quite great.

Considering the width in the front and rear direction of the detergent supply 200, the detergent supply 200 may be coupled to the rear protruding surface 30*b*1 at the upper portion of the rear panel 30*b* where the concave portion is not defined.

In this regard, the detergent supply 200 may partially extend into the door 30 through the rear panel 30*b*. To this end, a through-hole 30*b*2 through which the detergent supply 200 partially passes may be defined in the rear protruding surface 30*b*1 of the rear panel 30*b*. The through-hole 30*b*2 may have approximately a square hole shape corresponding to an outer appearance of the detergent supply 200.

Therefore, based on the closed state of the door 30, a rear portion of the detergent supply 200 may be exposed to the washing space 21 of the tub 20, and a front portion of the detergent supply 200 may pass through the rear panel 30*b* and be disposed inside the door 30.

In this regard, as will be described later, electrical components such as a detergent pump 230, a roller sensor 2391, and the like that are electrically operated may be disposed in the front portion of the detergent supply 200 disposed inside the door 30. Therefore, the electrical components constituting the detergent supply 200 may be not affected by the washing water.

Furthermore, as described above, a number of electrically operated components, in addition to the electrical components of the detergent supply 200, may be accommodated inside the door 30. To prevent the components from being affected by the washing water, water leak preventing means may be disposed between the detergent supply 200 and the rear panel 30*b* of the door 30.

As described above, the door 30 may be pivotably supported via a hinge bracket 37 disposed at a lower end of the door 30, and may be pivoted around the hinge bracket 37.

When the door 30 is closed, the detergent supply 200 may be disposed to face the inside of the washing space 21 and may be directed in a vertical direction. As such, when the detergent supply 200 is directed in the vertical direction, the detergent stored inside the detergent container 280, which will be described later, may flow downward based on gravity.

Additionally, when the door 30 is opened, the detergent supply 200 may be pivoted in a direction away from the tub 20, and may be directed in a horizontal direction in the full open state of the door 30.

After opening the door 30 and directing the detergent supply 200 in the horizontal direction, the user may open a cover 220 to be described later and mount the detergent container 280 inside the housing 210 or easily remove the detergent container 280 from the housing 210.

Hereinafter, a detailed structure of the detergent supply 200 will be described with reference to FIGS. 4 to 7.

FIGS. 4 to 7 show the aforementioned state in which the door 30 is closed and the detergent supply 200 is directed in the vertical direction. Hereinafter, unless otherwise described, a description will be made based on the state in which the detergent supply 200 is directed in the vertical direction.

First, the detergent supply 200 may include the housing 210 having a predetermined receiving space defined therein, and the cover 220 that opens and closes the receiving space of the housing 210.

The housing 210 forms an exterior of the detergent supply 200 and serves to accommodate or support other components constituting the detergent supply 200 therein.

The housing 210 may be formed to have a box shape in which a rear surface 210*a* is entirely open such that the predetermined receiving space is defined therein.

The detergent container 280, which will be described later, may be mounted or removed by passing through the open rear surface 210*a*. The cover 220, which will be described later, may be coupled to the open rear surface 210*a*, and the rear surface 210*a* may be closed by the cover 220.

For example, considering a shape of the detergent container 280 and a detergent storage capacity of the detergent container 280, a width in the front and rear direction of an upper portion of the housing 210 may be much greater than a width in the front and rear direction of a lower portion thereof.

In this regard, as the lower portion of the housing 210 having the smaller width in the front and rear direction than the upper portion, a space and a support structure where the detergent pump 230, a level sensor 240, and a detachment detection sensor 260 that are electrically operated as will be described later may be attached and supported may be formed at an outer side of the rear surface 210*a* of the housing 210.

Figure 5:
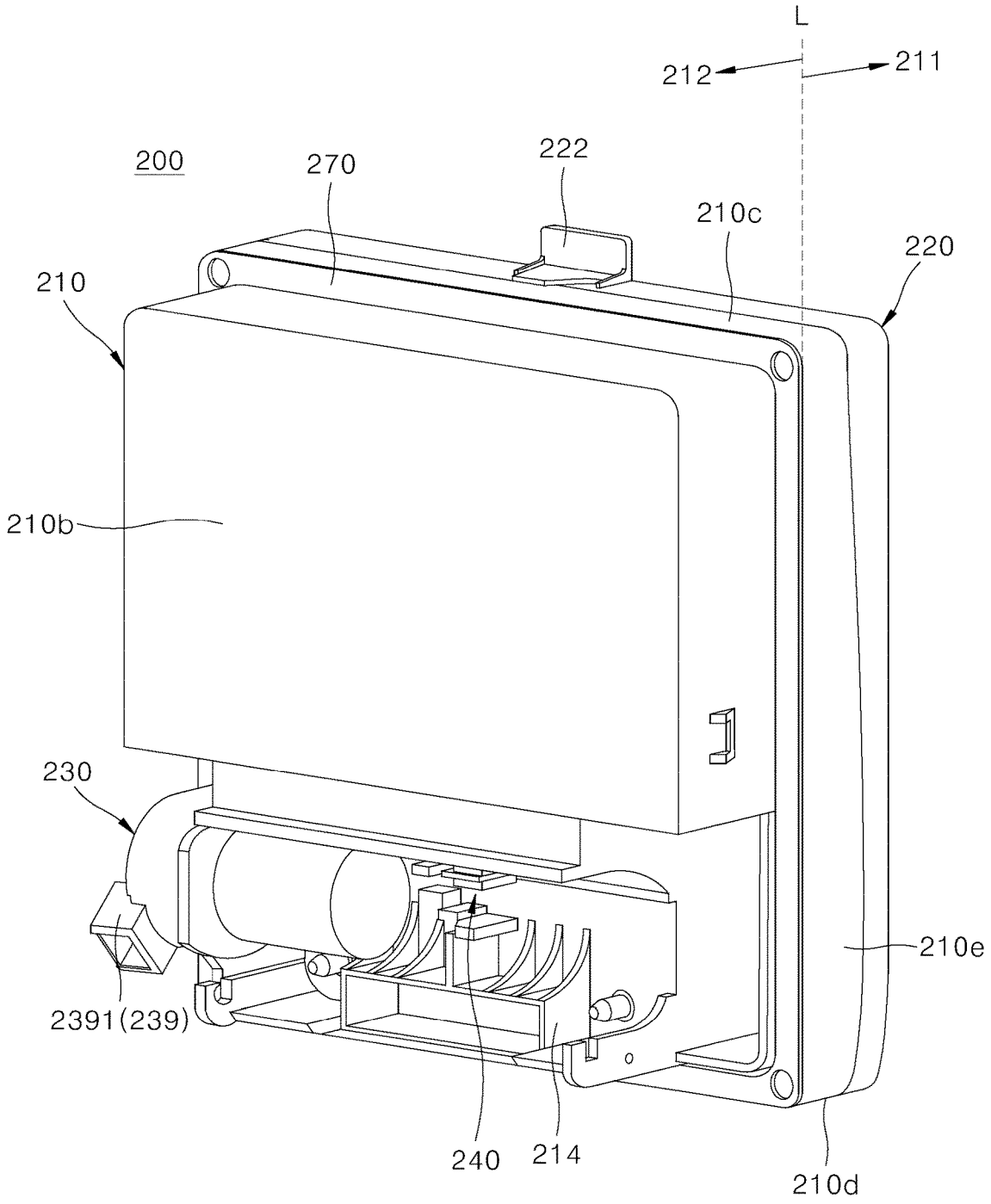

To install and support such detergent pump 230, level sensor 240, and detachment detection sensor 260, as shown in FIG. 5, a number of support ribs 214 having a predetermined shape may be formed integrally with the housing 210 at a lower portion of the rear surface 210*a* of the housing 210. In this regard, the support ribs 214 pass through the through-hole 30*b*2 of the rear panel 30*b* and are embedded inside the door 30. Therefore, considering ease of assembly, the support ribs 214 may be formed so as not to extend to the outside of the housing 210 beyond both side surfaces 210*e* and 210*f* and a bottom surface 210*d* of the housing 210.

In one example, the detergent supply 200 of the dish washer 1 according to the present disclosure may be constructed to supply a single type of detergent or supply two types of detergents.

As shown, the housing 210 may be formed to have an approximately bilaterally symmetrical shape so as to be commonly used for supplying the single type of detergent and supplying the two types of detergents.

When applied to supply the two types of detergents, the housing 210, which has the bilaterally symmetrical shape, may be divided in a left and right direction (a Le-Ri direction), and a right side of the housing 210 may be used for supplying a first detergent and a left side of the housing 210 may be used for supplying a second detergent.

Figure 4:
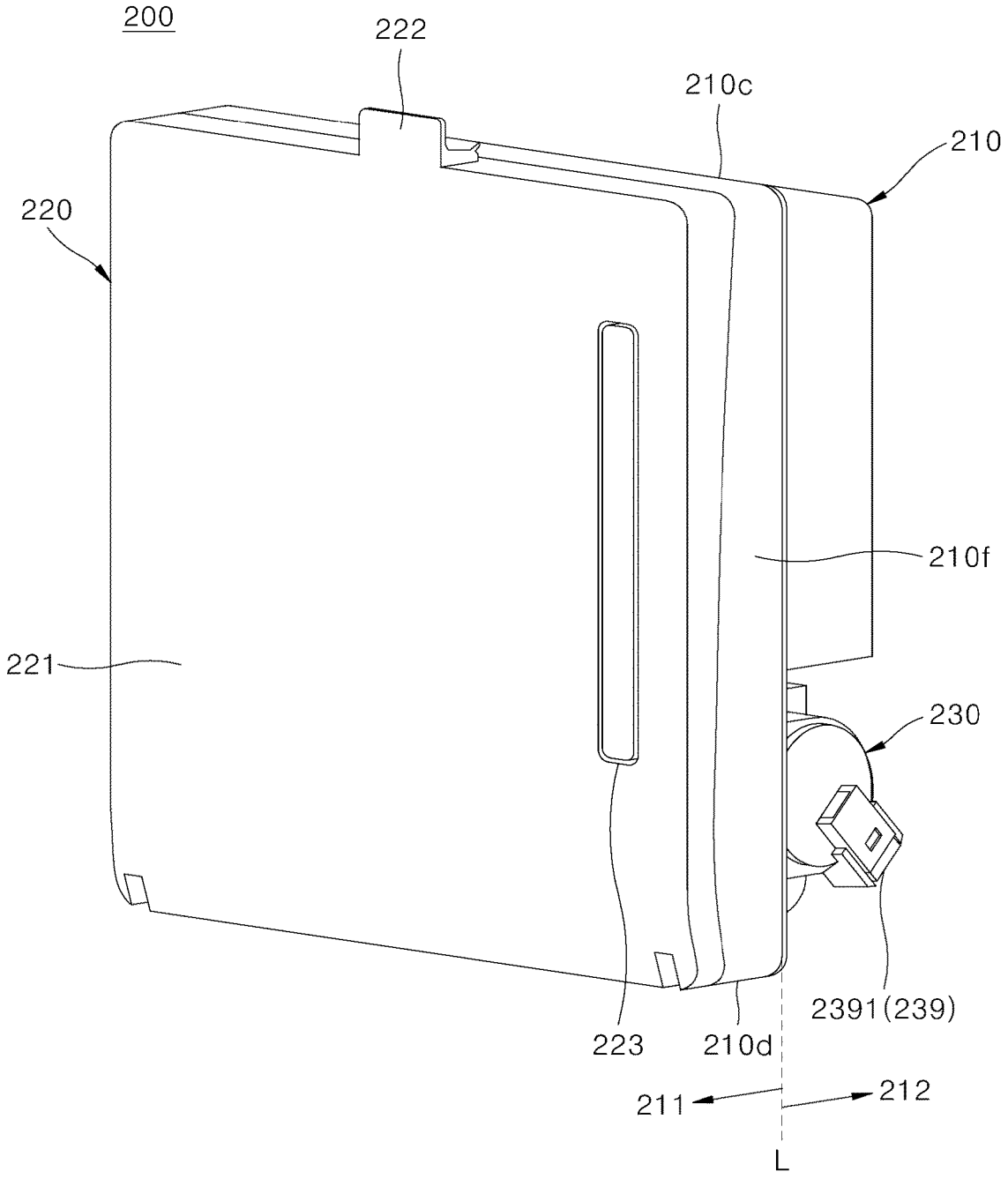
FIGS. 4 and 5 are a rear perspective view and a front perspective view showing a detergent supply with a door shown in FIG. 3 closed.

However, in an embodiment shown in FIG. 4 and subsequent drawings, components other than the housing 210 are applied for supplying the single type of detergent. The present disclosure is not limited thereto, but a description will be made below based on the embodiment in which the housing 210 is applied to the detergent supply 200 for supplying the single type of detergent, as shown.

In one example, as described above, in the state in which the detergent supply 200 is directed in the vertical direction, the detergent supply 200 may be installed on the rear panel 30*b* of the door 30 in the state in which the portion of the housing 210 is exposed to the washing space 21 of the tub 20 and the remaining portion of the housing 210 is embedded inside the door 30.

Accordingly, the housing 210 may have a shape of being divided along a front and rear direction (a F-R direction) centered on a virtual reference line L shown in FIG. 5. A portion of the housing 210 corresponding to a rear portion with respect to the virtual reference line L may be exposed to the washing space 21 and thus may be referred to as an exposed portion 211, and a portion of the housing corresponding to a front portion with respect to the virtual reference line L may be embedded inside the door 30 and thus may be referred to as an embedded portion 212.

In this regard, when cut along a plane perpendicular to the front and rear direction (the F-R direction), a cross-sectional area of the exposed portion 211 may be greater than a cross-sectional area of the embedded portion 212.

Accordingly, a predetermined stepped surface 213 may be formed at a rear end of the embedded portion 212 and a front end of the exposed portion 211, which correspond to a boundary between the exposed portion 211 and the embedded portion 212.

The stepped surface 213 serves to increase a contact area size or a coupling area size with the rear panel 30*b* when fastened to the rear panel 30*b* of the door 30. To this end, the stepped surface 213 may be constructed to have a shape corresponding to a shape of the rear surface of the rear panel 30*b*.

In addition, fastening holes through which fastening means such as a screw bolt passes may be respectively defined at four top, bottom, left, and right corners of the stepped surface 213.

In one example, as described above, the water leak preventing means may be disposed between the detergent supply 200 and the rear panel 30*b* of the door 30 such that the electrical components of the detergent supply 200 and a number of electrical components that are disposed inside the door 30 are not affected by the washing water.

As the water leak preventing means, a gasket 270 that is interposed between the stepped surface 213 and the rear panel 30*b* of the door 30 and is made of a material having a predetermined elasticity may be disposed.

As shown in FIG. 5, the gasket 270 may be coupled to the stepped surface 213 and may be formed to have a shape corresponding to a shape of the stepped surface 213.

In more detail, the gasket 270 may be constructed to have a width corresponding to a width of the stepped surface 213, and may have a thickness sufficient to provide a predetermined elastic force.

In one example, the cover 220 is detachably connected to the housing 210 and serves to open and close the open rear surface 210*a* of the housing 210.

As an example, similar to the door 30 described above, the cover 220 may be constructed to pivot to open and close the internal receiving space of the housing 210. To this end, a cover body 221 may have a size to entirely cover the rear surface 210*a* of the housing 210.

Additionally, a lower end of the cover body 221 may be pivotably connected to the housing 210.

In one example, a fastener 222 may be disposed at an upper end of the cover body 221 as means for providing detachable coupling to the housing 210.

As an example, the fastener 222 may include a lever extending upward from the upper end of the cover body 221, and a fastening tab integrally connected to the lever and extending in the horizontal direction.

Although not shown, a locking protrusion to which the fastening tab is elastically coupled may be disposed on a top surface 210*c* close to the rear surface 210*a* of the housing 210.

Therefore, the user may easily release a locked state between a fastening protrusion and the locking protrusion by pulling the lever in the direction away from the housing 210.

In one example, a through-hole 223 that extends along the vertical direction (the U-D) and whose width in the left and right direction is maintained approximately constant may be defined in the cover body 221.

When the cover 220 is fastened to the housing 210, the through-hole 223 may be defined at a location corresponding to a transparent window 2813 of the detergent container 280, which will be described later.

Therefore, the user may easily visually check a level and a remaining amount of the detergent stored inside the detergent container 280 via the through-hole 223 of the cover 220 and the transparent window 2813 of the detergent container 280.

In one example, the detergent supply 200 may further include the detergent container 280 inside which the detergent to be supplied to the washing space 21 of the tub 20 is stored.

Figure 6:
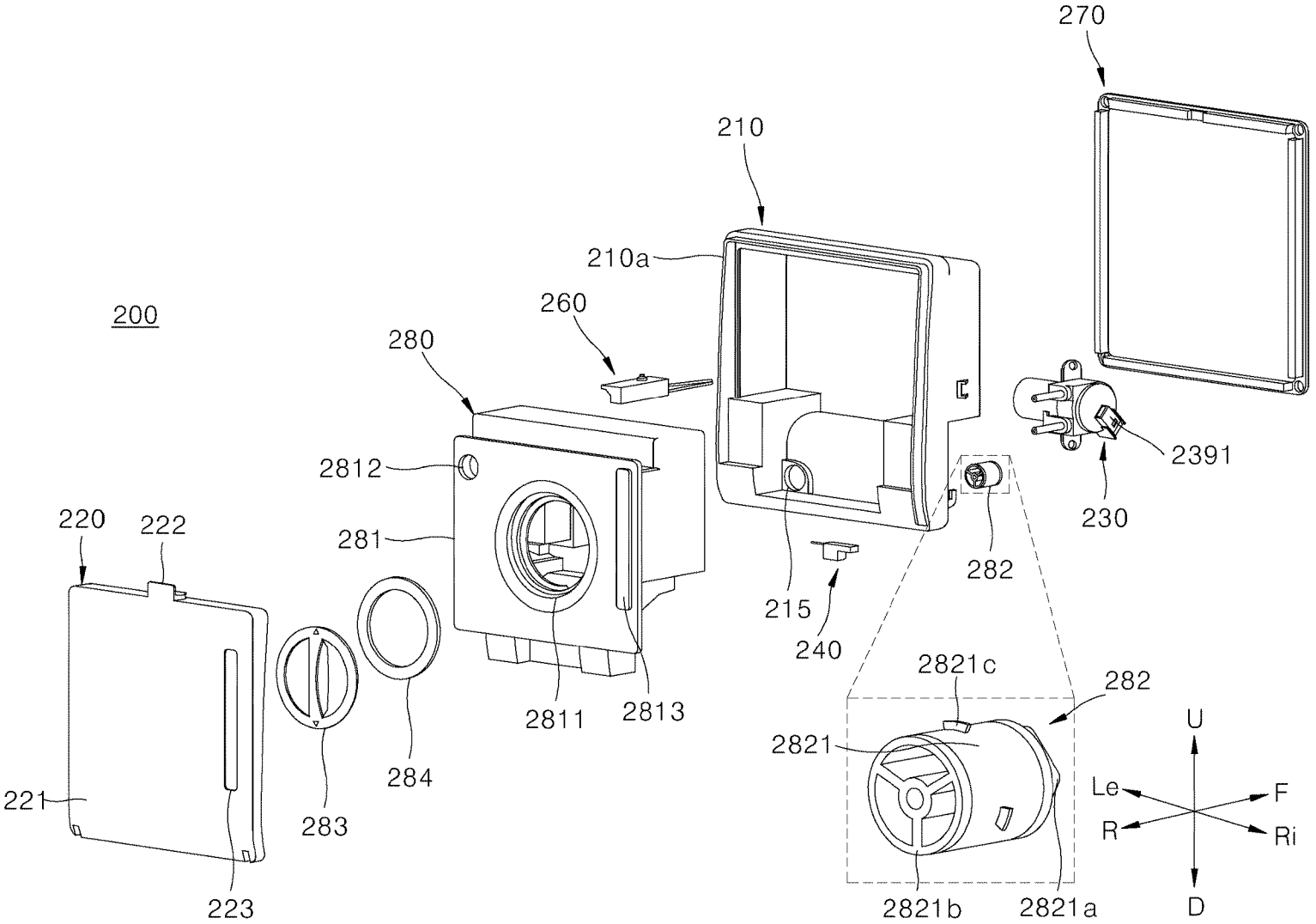
FIG. 6 is an exploded perspective view of FIG. 4.
Figure 7:
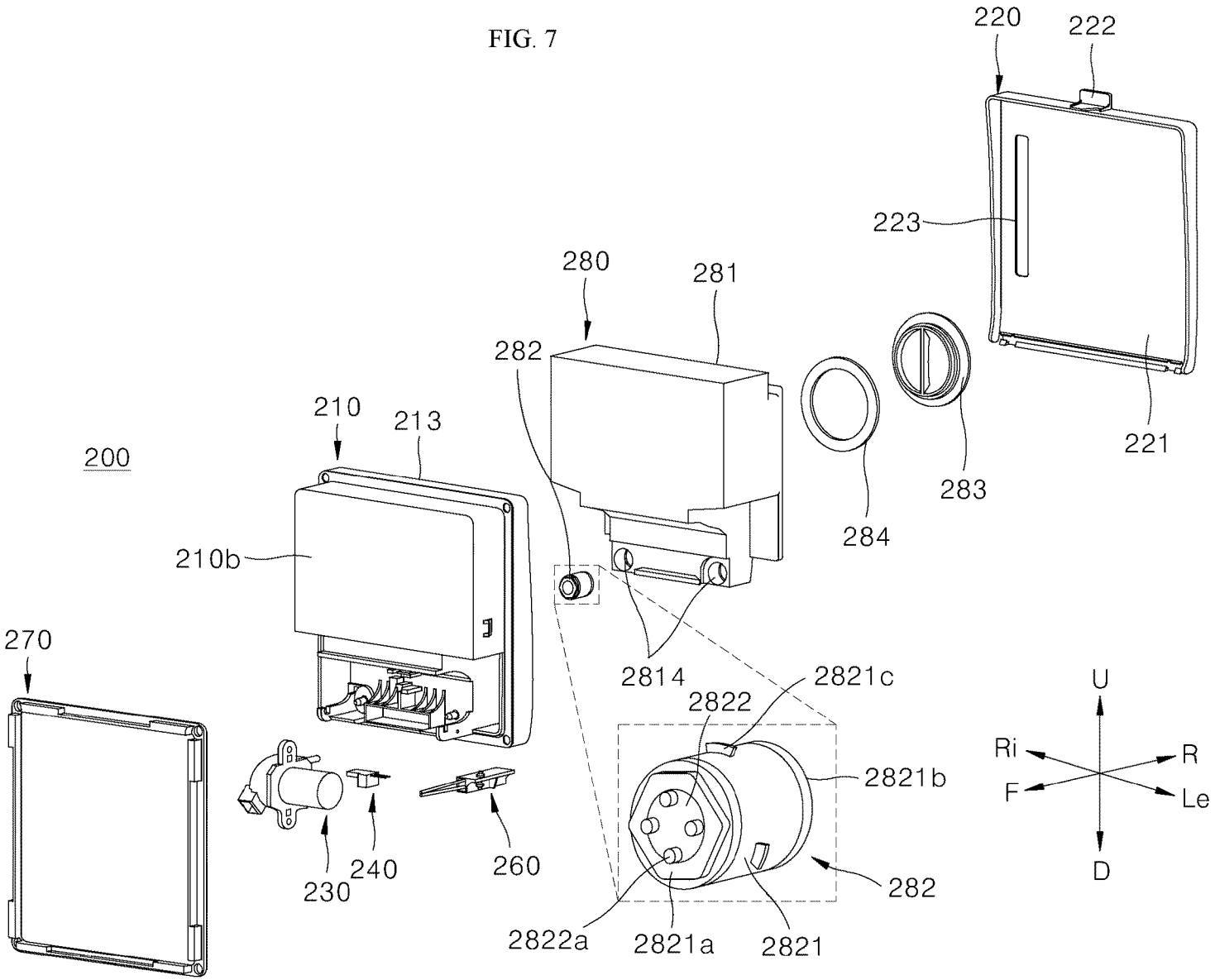
FIG. 7 is an exploded perspective view of FIG. 5.
Figure 8:
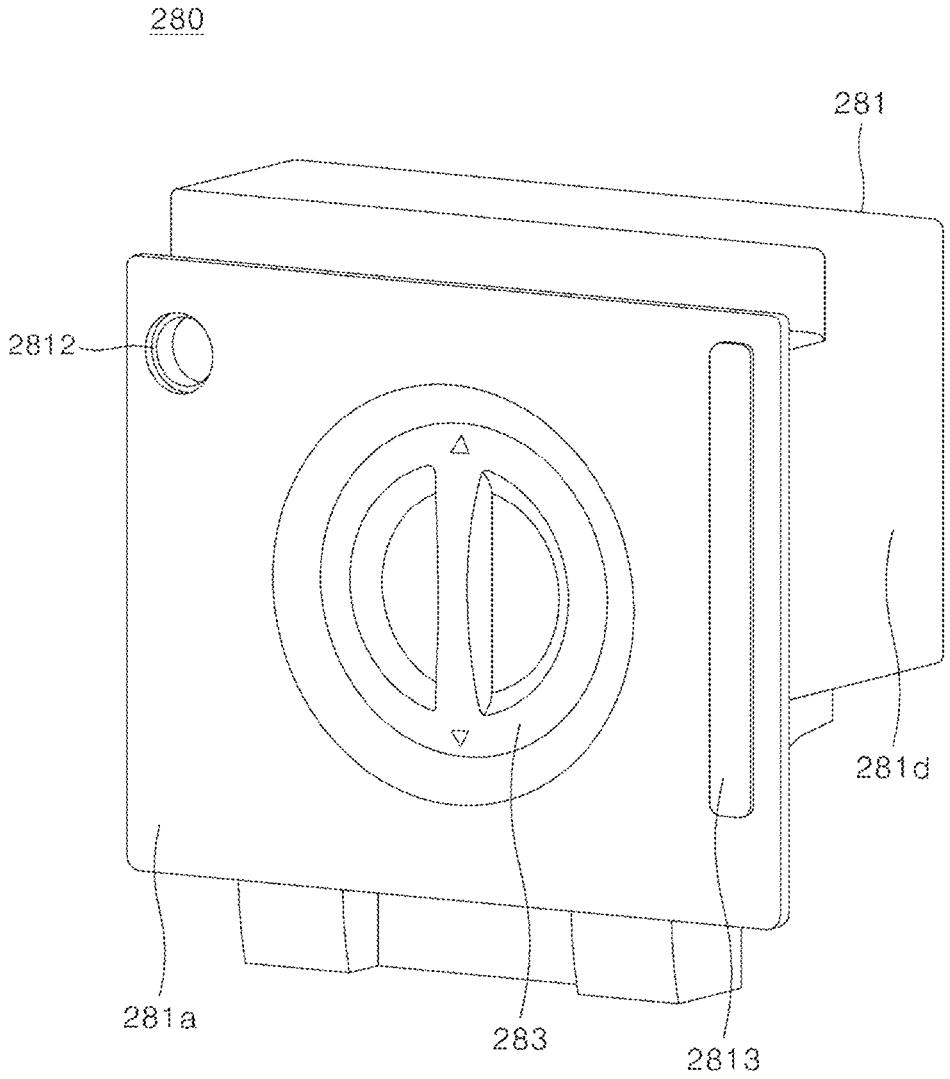
FIG. 8 is a rear perspective view of a detergent container shown in FIGS. 6 and 7.
Figure 9:
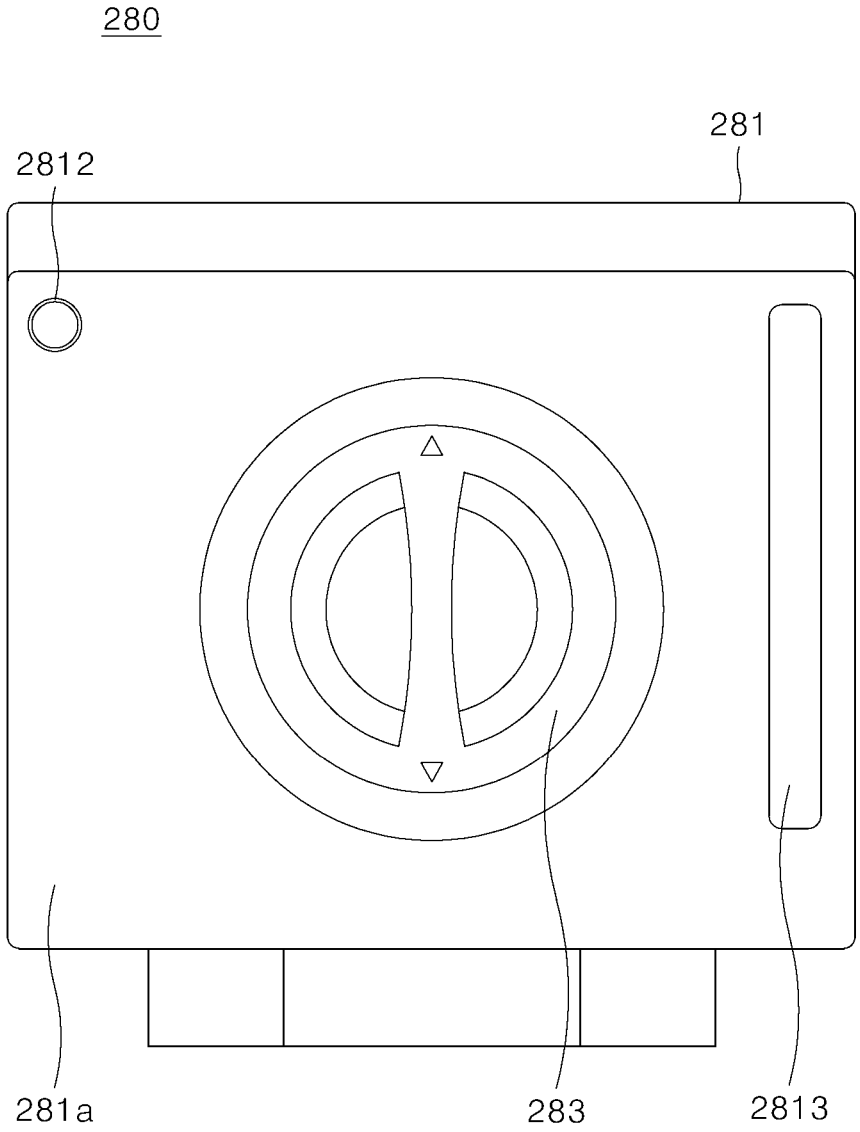
FIG. 9 is a rear view of a detergent container shown in FIG. 8.

As shown in FIGS. 6 and 7, the container body 281 of the detergent container 280 may have a container shape with a predetermined detergent storage space defined therein.

In addition, as described above, the detergent container 280 is entirely accommodated in the internal receiving space of the housing 210, so that the container body 281 may have an outer appearance corresponding to a shape of the internal receiving space of the housing 210.

An inlet 2811 for detergent replenishment may be defined at a center of a rear surface of the container body 281.

A sealing cap 283 may be detachably coupled to the inlet 2811. Therefore, the user may open the inlet 2811 by removing the sealing cap 283 from the inlet 2811 and replenish the detergent via the inlet 2811.

As shown, a sealing ring 284 made of a material with a predetermined elasticity may be added between the inlet 2811 and the sealing cap 283 to prevent leakage of the detergent.

In one example, a ventilation hole 2812 defined through the rear surface of the container body 281 may be defined at an upper end of the rear surface of the container body 281.

With the internal storage space of the container body 281 closed by the sealing cap 283, the ventilation hole 2812 is used to compensate for a phenomenon in which a pressure of the internal storage space becomes lower than an atmospheric pressure as the supply of the detergent progresses.

However, because there is a possibility that the detergent may leak via the ventilation hole 2812, detergent leak preventing means such as an air valve or a membrane may be added to the ventilation hole 2812.

As described above, the transparent window 2813 corresponding to the through-hole 223 of the cover 220 may be formed on the rear surface of the container body 281. To visually check the level and the remaining amount of the detergent stored inside the container body 281, the transparent window 2813 may be made of a transparent or translucent material capable of transmitting visible light.

In one example, as shown in FIG. 7, a detergent outlet 2814 may be formed at a lower end of a front surface of the container body 281.

The detergent outlet 2814 may be placed at the lowermost end of the container body 281 such that the detergent may easily flow by gravity.

It is shown in FIG. 7 that a pair of detergent outlets 2814 are disposed at left and right sides of the front surface of the container body 281, but this is for commonization as the detergent container 280 for supplying the two types of detergents. When the detergent container 280 for supplying the single type of detergent is used as in the present embodiment, the detergent outlet 2814 on the left may be in a closed state.

A container valve 282 may be coupled to the detergent outlet 2814. The container valve 282 closes the detergent outlet 2814 when the container body 281 is removed and separated from the housing 210, and opens the detergent outlet 2814 when the container valve 282 is mounted on the housing 210.

A valve coupling portion 215 to which the container valve 282 is coupled when the detergent container 280 is mounted may be formed inside the housing 210. When the container valve 282 is coupled to the valve coupling portion 215 of the housing 210, the container valve 282 may open at the same time as the coupling, and the detergent outlet 2814 may open.

As shown in partially enlarged views in FIGS. 6 and 7, the container valve 282 may be composed of a valve body 2821 in which a front end 2821*a* and a rear end 2821*b* are at least partially open, a plug 2822 that is movably disposed in the front and rear direction inside the valve body 2821 and opens and closes an open portion of the front end 2821*a* of the valve body 2821, and a spring (not shown) that provides a restoring force to the plug 2822.

As shown, the valve body 2821 may have a cylindrical outer appearance, and an internal passage through which the detergent flows may be defined therein.

The internal passage is in communication with the open portion formed at the front end 2821*a* of the valve body 2821 and an open portion formed at the rear end 2821*b*.

The rear end 2821*b* of the valve body 2821 may be firmly coupled to the detergent outlet 2814 of the container body 281. Therefore, the detergent supplied from the container body 281 may be introduced via the open portion of the rear end 2821*b* of the valve body 2821 and may flow along the internal passage of the valve body 2821.

The front end 2821*a* of the valve body 2821 may be coupled to the valve coupling portion 215 (see FIG. 12) of the housing 210.

Therefore, the detergent flowing along the internal passage of the valve body 2821 may be discharged via the open portion of the front end 2821*a* of the valve body 2821 and may be supplied to the valve coupling portion 215 of the housing 210.

The plug 2822 is disposed inside the valve body 2821 and serves to open and close the open portion of the front end 2821*a* of the valve body 2821.

Therefore, the plug 2822 may have a shape corresponding to the open portion of the front end 2821*a* of the valve body 2821.

The plug 2822 is pressed in a direction to close the open portion of the front end 2821*a* of the valve body 2821 by the spring (not shown).

In one example, at least one contact protrusion 2822*a* that protrudes in a direction away from the valve body 2821 may be integrally formed with a front end surface of the plug 2822.

The contact protrusion 2822*a* may be formed to protrude farther from the container body 281 than the front end surface of the plug 2822 and the front end 2821*a* of the valve body 2821.

Therefore, when the container body 281 is mounted on the housing 210, the contact protrusion 2822*a* of the plug 2822 first comes into contact with an end surface of the valve coupling portion 215.

Additional movement of the plug 2822 may be blocked by the contact between the contact protrusion 2822*a* and the valve coupling portion 215.

Therefore, when the container body 281 continues to be mounted on the housing 210, a relative movement of the front end 2821*a* of the valve body 2821 may continue while the movement of the plug 2822 is blocked.

As the relative movement of the valve body 2821 with respect to the plug 2822 progresses, a gap may occur between the plug 2822 and the open portion of the front end 2821*a* of the valve body 2821, and the gap may gradually expand. As such a gap is defined, the container valve 282 may be switched from a closed state to an open state.

With such a gap, the detergent may flow from the container valve 282 to the valve coupling portion 215, and the detergent may be supplied from the container body 281.

In one example, when the container body 281 is removed from the housing 210, the contact protrusion 2822*a* of the plug 2822 may be removed from the end surface of the valve coupling portion 215. In this case, the gap between the plug 2822 and the open portion of the front end 2821*a* of the valve body 2821 may be immediately released by the restoring force of the spring described above, and the valve body 2821 may return to the closed state.

In one example, as shown, at least one stopper 2821*c* for determining an insertion depth and an insertion location with respect to the detergent outlet 2814 of the container body 281 may be integrally formed on an outer circumferential surface of the valve body 2821.

In addition, as shown, the sealing ring for preventing the leakage of the detergent between an inner circumferential surface of the valve coupling portion 215 and the valve body 2821 may be further disposed at a side of the front end 2821*a* of the valve body 2821.

However, such a configuration of the container valve 282 is merely illustrative. As long as means is in the closed state when removed from the housing 210 and is switched to the open state when mounted on the housing 210, the means may be applied to the present disclosure without limitation.

In one example, the detachment detection sensor 260 may be attached to the housing 210 as means to detect the state in which the detergent container 280 is mounted on or removed from the housing 210.

As described above, the detachment detection sensor 260 may be disposed in the embedded portion 212 of the housing 210 so as not to be affected by the washing water, and as shown by way of example, may be attached at a location below the front surface 210*b* of the housing 210 and close to a left side surface.

As an example, the detachment detection sensor 260 may be of a hall sensor type that detects a magnetic force.

Correspondingly, the container body 281 may have a magnetic body (not shown) that emits a predetermined magnetic force at a location corresponding to the location of the detachment detection sensor 260 when the detergent container 280 is mounted on the housing 210.

The detachment detection sensor 260 may be electrically connected to a controller 100, which will be described later, and an output signal of the detachment detection sensor 260 may be transmitted to the controller 100. The controller 100 may easily identify whether the detergent container 280 is mounted on the housing 210 or is removed from the housing 210 via the received output signal of the detachment detection sensor 260.

Additionally, the level sensor 240 may be attached to the housing 210 as means to check the remaining amount of the detergent stored inside the container body 281.

Like the detachment detection sensor 260, the level sensor 240 may be disposed in the embedded portion 212 of the housing 210 so as not to be affected by the washing water, and as shown by way of example, may be located below the front surface of the housing 210 and at a center of the housing 210.

Similar to the detachment detection sensor 260, the level sensor 240 may be formed as the hall sensor that detects the magnetic force.

Correspondingly, a floater (not shown) that may move in the vertical direction (the U-D) based on a level of the detergent may be disposed inside the container body 281.

A magnetic body that emits a predetermined magnetic force may be attached to the floater, and the detachment detection sensor 260 may generate the output signal corresponding to an intensity of the magnetic force emitted from the magnetic body of the floater.

Similar to the detachment detection sensor 260, the level sensor 240 may be electrically connected to the controller 100, which will be described later, and an output signal of the level sensor 240 may be transmitted to the controller 100. The controller 100 may easily identify the remaining amount of the detergent stored inside the container body 281 via the received output signal of the level sensor 240.

In one example, the detergent supply 200 may further include the detergent pump 230 for providing the detergent stored in the detergent container 280 to the washing space 21 of the tub 20.

In the present embodiment, the detergent pump 230 may be formed as a tube pump operated by the electric motor to facilitate control of a detergent supply amount.

As known in the art, the tube pump may be constructed to pump the detergent in a scheme of pressurizing a flexible tube with a detergent flow passage defined therein via at least one roller to push the detergent and allow the detergent to flow.

The embodiment shown in FIGS. 4 to 7 shows the configuration with the single detergent pump 230 for supplying the single type of detergent, but when applied for supplying the two types of detergents, the detergent pump 230 having the same specifications may be additionally disposed.

Similar to the detachment detection sensor 260 and the level sensor 240 described above, the detergent pump 230 that is electrically operated may be disposed in the embedded portion 212 of the housing 210 so as not to be affected by the washing water, and as an example, the detergent pump 230 may be installed on and fixed to the support rib 214 formed below the front surface of the housing 210.

In one example, a roller sensor 2391 that senses a location of a roller 233, which pressurizes a tube 232 to allow the detergent to flow, and generates an output signal corresponding to the location of the roller 233 may be attached to the detergent pump 230.

The roller sensor 2391 may be electrically connected to the controller 100, which will be described later, and the output signal of the roller sensor 2391 may be transmitted to the controller 100. The controller 100 may calculate the number of revolutions of the roller 233 via the received output signal of the roller sensor 2391, and may easily determine the detergent supply amount accordingly.

[Detailed Configuration of Detergent Container]

Hereinafter, referring to FIGS. 8 to 12, a configuration of the detergent container 280 disposed in the detergent supply 200 of the dish washer 1 according to one embodiment of the present disclosure will be described.

As described above, a predetermined detergent storage space may be defined inside the container body 281 of the detergent container 280.

Liquid detergent to be supplied to the tub 20 via the detergent pump 230 may be stored in the detergent storage space.

The detergent storage space may be an internal space closed by a rear surface 281*a*, a front surface 281*b*, a left side surface 281*c*, a right side surface 281*d*, and the like of the detergent container 280.

As such, a portion inside the detergent container 280 that defines the detergent storage space will be referred to as a storage 2815.

Figure 10:
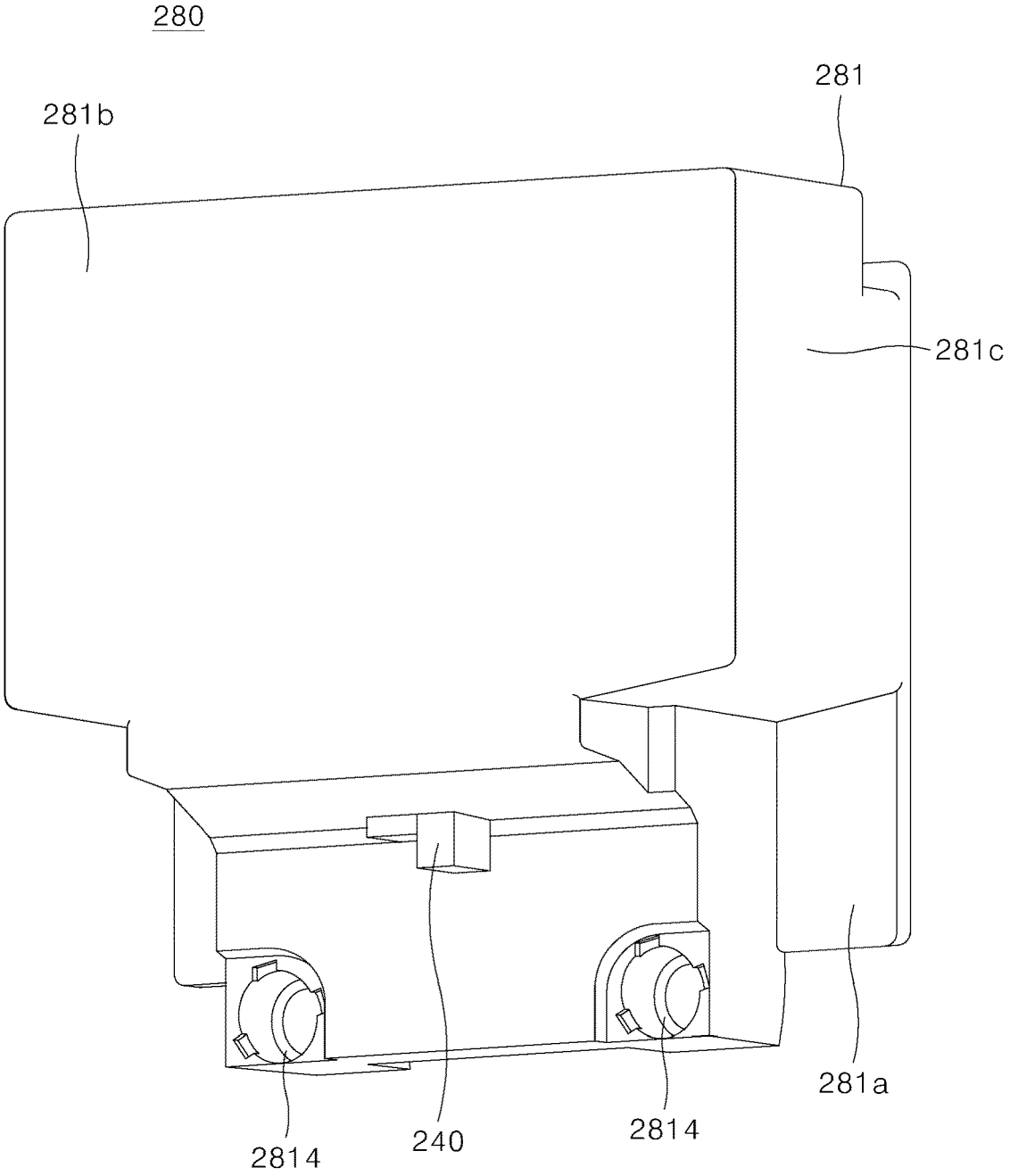
FIG. 10 is a front perspective view of a detergent container shown in FIG. 8.
Figure 11:
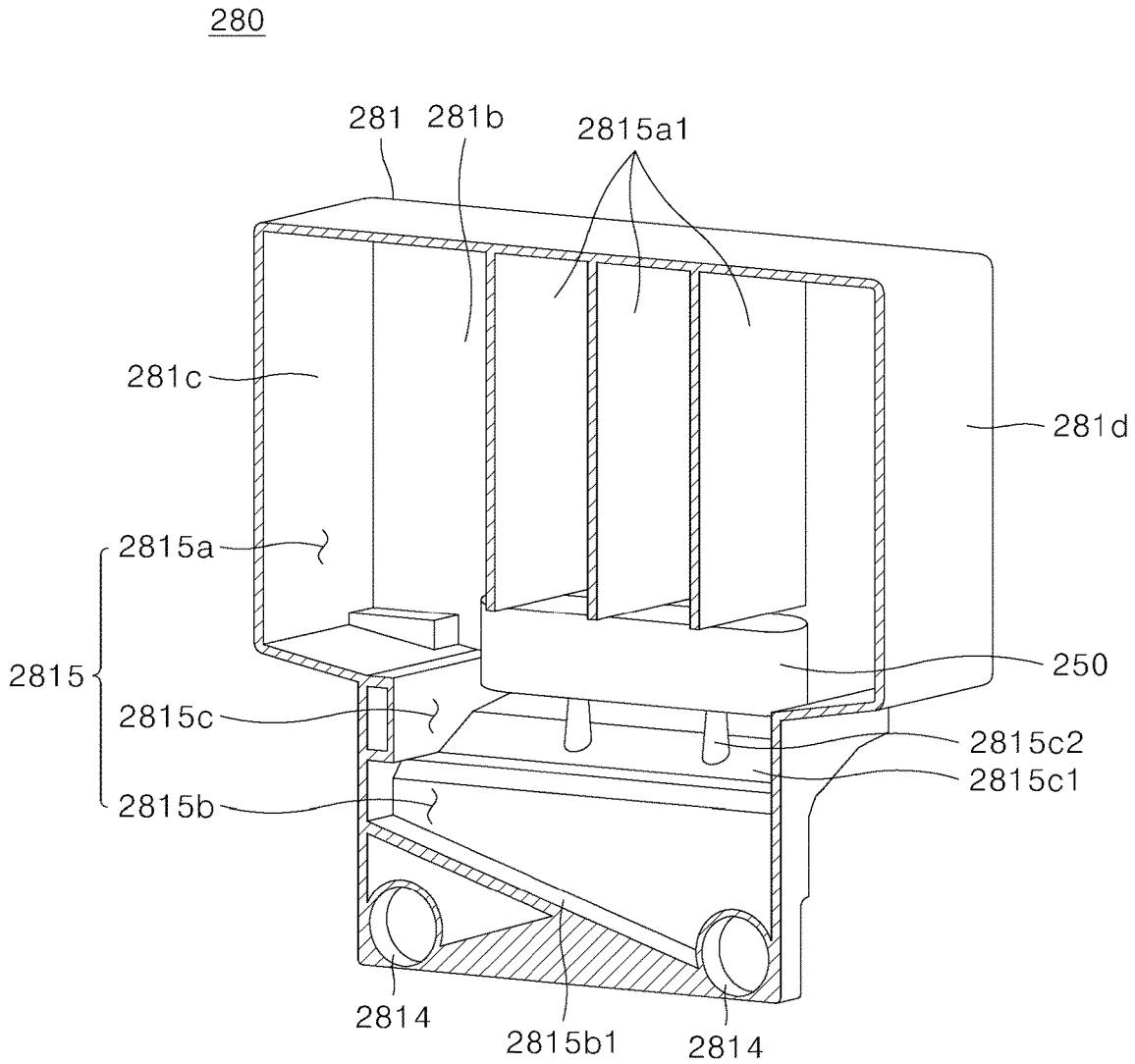
FIG. 11 and FIG. 12 are cross-sectional views of a detergent container shown in FIG. 10 cut along a plane perpendicular to a front and rear direction.
Figure 12:
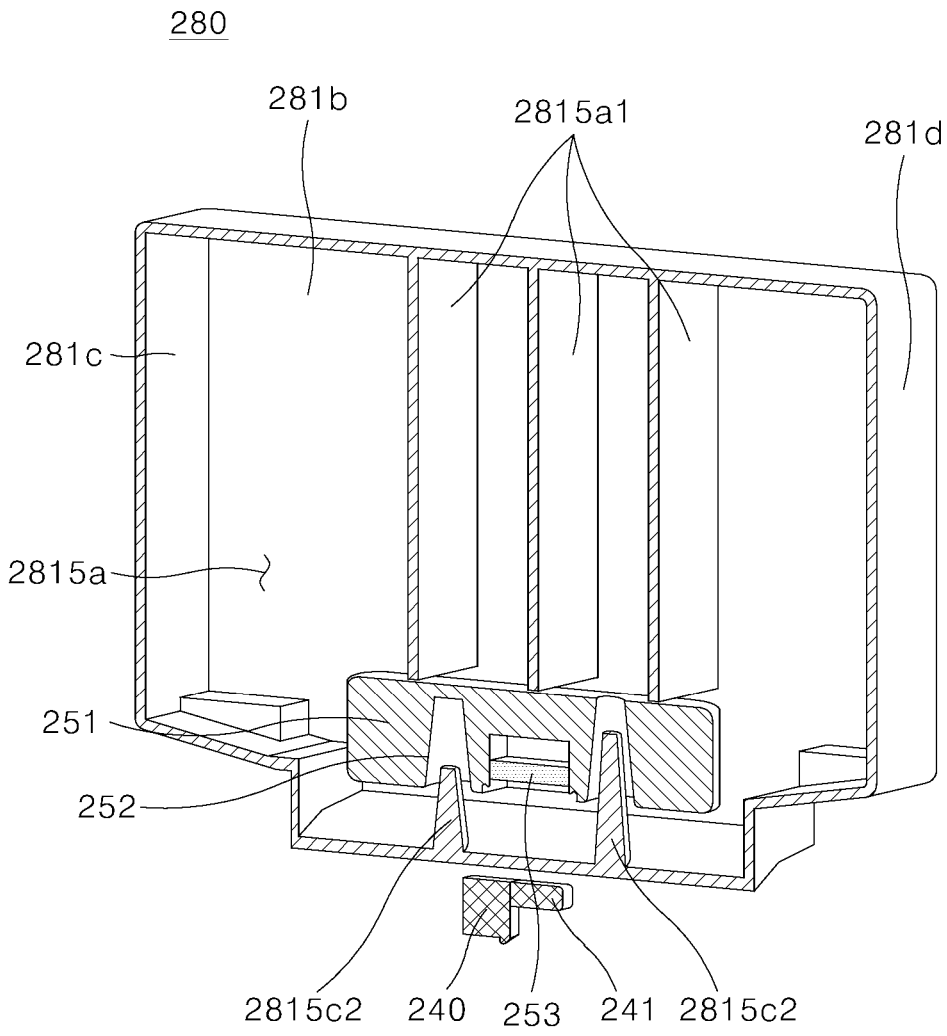

Referring to FIGS. 10 to 12, the storage 2815 may be divided into a main space 2815*a* that occupies most of the detergent storage space, a guidance space 2815*b* that guides the detergent stored in the main space 2815*a* to the detergent outlet 2814, and a connection space 2815*c* that connects the main space 2815*a* with the guidance space 2815*b*.

The main space 2815*a* may have much greater front and rear direction width and vertical direction width than the guidance space 2815*b* and the connection space 2815*c* to secure a minimum detergent storage capacity.

However, considering constraints on a location where the detergent supply 200 is disposed, a cross-sectional area cut in a direction parallel to a horizontal plane of the main space 2815*a* may be maintained approximately constant in the vertical direction.

The guidance space 2815*b* serves to guide the detergent stored in the main space 2815*a* to the detergent outlet 2814. To allow the detergent to flow smoothly by gravity in a vertically disposed state, the guidance space 2815*b* may have a first inclined surface 2815*b*1 whose location in the vertical direction gradually decreases toward the detergent outlet 2814.

The connection space 2815*c* serves to connect the main space 2815*a* with the guidance space 2815*b* and guide the detergent stored in the main space 2815*a* to the guidance space 2815*b*.

To this end, a cross-sectional area cut in the direction parallel to the horizontal plane of the connection space 2815*c* may gradually decrease in the vertical direction.

To this end, a front surface of the connection space 2815*c* may be composed of a second inclined surface 2815*cl* that is inclined rearwards in a downward direction.

In one example, as described above, a floater 250 that moves along the vertical direction in response to a level of the detergent may be disposed inside the storage 2815.

FIGS. 11 and 12 illustrate the floater 250 having an outer appearance in which a width in a left and right direction is greater than a width in the vertical direction and a width in a front and rear direction. The present disclosure is not limited thereto, but a description will be made based on the floater 250 having the shape shown.

In one example, the floater 250 may be made of a material with a lower density than the detergent stored in the detergent storage space of the storage 2815. Accordingly, the floater 250 may move in the vertical direction by buoyancy based on the level of the detergent while remaining partially submerged in the detergent.

In one example, as described later, a location in the vertical direction of the floater 250 may be different depending on a viscosity of the detergent stored in the detergent storage space. For example, when a certain volume of detergent is put into the detergent storage space, the location in the vertical direction of the floater 250 may vary because the buoyancy acts differently on the floater 250 depending on the viscosity of the detergent. Accordingly, whether the detergent put into the detergent storage space is a high-viscosity detergent, a medium-viscosity detergent, or a low-viscosity detergent may be identified.

As means to increase the buoyancy of the floater 250, a hollow may be defined inside the floater 250.

In this regard, a magnetic body 253 that emits a predetermined magnetic force may be disposed in the hollow.

The floater 250 may be disposed in the storage 2815 so as to be movable along the vertical direction, but a range of movement in the vertical direction may be limited to a certain level.

As means to limit the range of movement in the vertical direction of the floater 250, at least one stopper rib 2815*a*1 and at least one guide bar 2815*c*2 may be disposed inside the storage 2815.

The stopper rib 2815*a*1 may be disposed in the main space 2815*a* and may be a barrier-shaped rib integrally connected to the front surface 281*b* and the top surface of the detergent container 280.

FIGS. 11 and 12 show an embodiment in which a total of three stopper ribs 2815*a*1 are disposed in consideration of the shape of the floater 250 in which the left and right direction is a longitudinal direction. When the shape of the floater 250 changes, the number of stopper ribs 2815*a*1 may be adjusted.

While moving based on the level of the detergent, a top surface of the floater 250 comes into contact with a lower end of the individual stopper rib 2815*a*1.

As shown in FIGS. 11 and 12, when the top surface of the floater 250 comes into contact with the lower end of the individual stopper rib 2815*a*1, an upward movement of the floater 250 may be restricted. Therefore, the individual stopper rib 2815*a*1 plays a role in defining the highest location in the vertical direction of the floater 250.

The guide bar 2815*c*2 may have a cone-shaped outer appearance that has a lower end integrally formed with the second inclined surface 2815*cl* of the connection space 2815*c* and protrudes upwards.

FIGS. 11 and 12 show an embodiment in which a pair of first and second guide bars 2815*c*2 are disposed in consideration of the shape of the floater 250 in which the left and right direction is the longitudinal direction. When the shape of the floater 250 changes, the number of guide bars 2815*c*2 may be adjusted.

Corresponding to the shape of the guide bars 2815*c*2, a pair of first and second guide grooves 252 may be defined inside the floater 250.

The first and second guide bars 2815*c*2 may be inserted into the first and second guide grooves 252, respectively. Accordingly, the floater 250 may move along the vertical direction, but a movement in the front and rear direction and a movement in the left and right direction thereof may be limited by the first and second guide bars 2815*c*2.

In this regard, as shown, protrusion heights of the first and second guide bars 2815*c*2 may be different from each other.

This is to minimize a contact area size between the first and second guide bars 2815*c*2 and the first and second guide grooves 252 of the floater 250.

In addition, to minimize the contact area size between the first and second guide bars 2815*c*2 and the first and second guide grooves 252 of the floater 250, gradients of the first and second guide bars 2815*c*2 may be different from gradients of the first and second guide grooves 252, respectively. That is, the gradients of the first guide bar and the first guide groove may be different from each other, and the gradients of the second guide bar and the second guide groove may be different from each other.

Accordingly, even when the floater 250 moves to the lowest location in the vertical direction, although the guide bar 2815*c*2 and the guide groove 252 are in line contact with each other, the guide bar 2815*c*2 and the guide groove 252 may be prevented from being in surface contact with each other. Therefore, the guide bar 2815*c*2 and the guide groove 252 may be effectively prevented from sticking to each other by the detergent.

In one example, the lowest location of the floater 250 may be defined by one with the greater protrusion height among the first and second guide bars 2815*c*2 and one with the greater height among the first and second guide grooves 252.

In one example, as shown in FIG. 10, a detergent level sensor 240 may be disposed outside the second inclined surface 2815*cl* as means to sense the location in the vertical direction of the floater 250.

As described above, by way of example, the detergent level sensor 240 may be a hall sensor that senses the magnetic force emitted from the magnetic body disposed in the floater 250 and generates an output signal corresponding to an intensity of the magnetic force.

As shown in FIG. 12, a sensing surface 241 of the detergent level sensor 240 may be located at a closest location immediately below the magnetic body 253 disposed in the floater 250 in the vertical direction or along the moving direction of the floater 250. That is, the detergent level sensor 240 may be disposed such that at least an overlapping area is generated between the sensing surface 241 and the magnetic body 253 when the floater 250 is moved downwards along the moving direction. Accordingly, miniaturization of the magnetic body 253 and the detergent level sensor 240 is achieved.

As will be described later, the output signal of the detergent level sensor 240 may be transmitted to the controller 100, and the controller 100 may effectively determine a current location of the floater 250 and a level change of the detergent via the received output signal.

In this regard, an amount of change in the level of the detergent sensed via the detergent level sensor 240 and the floater 250 may be a standard for determining the viscosity of the detergent stored in the detergent storage space of the storage 2815.

[Configuration of Controller and Method for Controlling Dish Washer]

Hereinafter, referring to FIG. 13, a configuration of the controller 100 of the dish washer 1 according to one embodiment of the present disclosure will be described.

Figure 13:
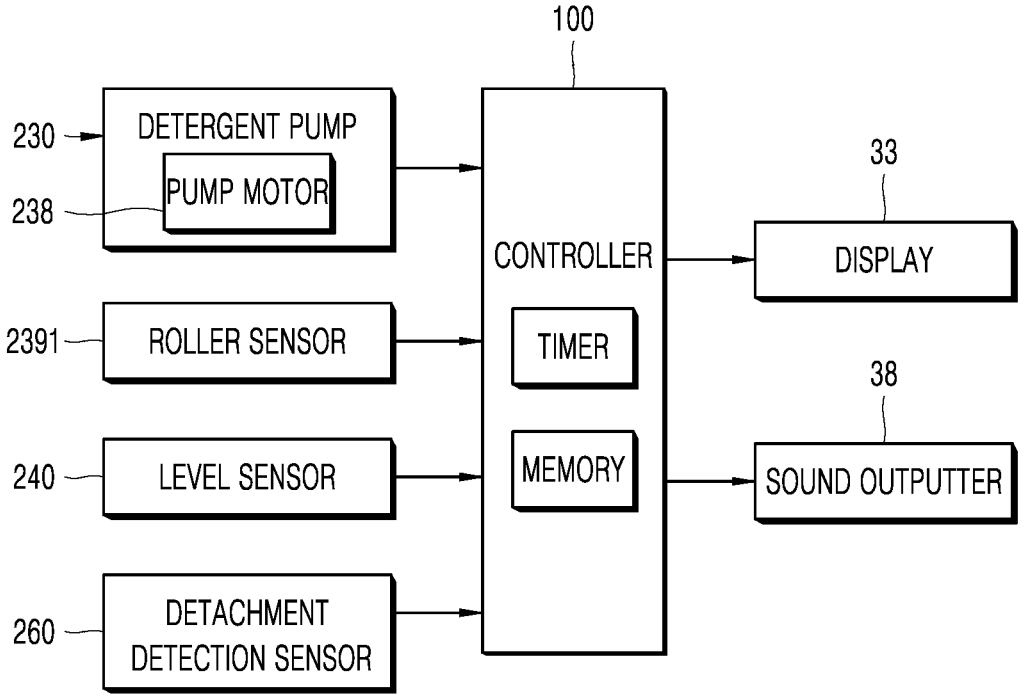
FIG. 13 is a functional block diagram for illustrating a configuration of a controller of a dish washer according to an embodiment of the present disclosure.

As shown in FIG. 13, the dish washer 1 according to one embodiment of the present disclosure may include the controller 100 for controlling each functional component.

The controller 100 may be of various forms such as a microcontroller, a microcomputer, or a microprocessor, as known in the art.

First, the controller 100 may be electrically connected to the pump motor 238 of the detergent pump 230. After the washing process is initiated, the controller 100 may perform control such that the power is supplied to the pump motor 238 to operate the detergent pump 230 and the detergent is supplied to the tub 20.

Additionally, the controller 100 may be electrically connected to the roller sensor 2391 for sensing the change in the location of the roller 2331 in real time during the washing process.

As an example, when the magnetic body disposed in the roller 233 exists within a sensing area, the roller sensor 2391 may generate a first output signal and transmit the first output signal to the controller 100, and when the magnetic body of the roller 233 is out of the sensing area and exists in a non-sensing area, the roller sensor 2391 may generate a second output signal and transmit the second output signal to the controller 100.

The first output signal may contain information indicating that the roller 233 is within the sensing area of the roller sensor 2391, and the second output signal may contain information indicating that the roller 233 is out of the sensing range of the roller sensor 2391 and exists in the non-sensing area.

The controller 100 may identify that the roller 233 has rotated and the location of the roller 233 has changed when the signal received from the roller sensor 2391 changes from the first output signal to the second output signal or from the second output signal to the first output signal. By calculating the number of location changes of the roller 233 as such, the controller 100 may calculate the number of revolutions of the roller 233 and determine whether the supply of the detergent with a preset supply amount has been completed.

In one example, the controller 100 may be electrically connected to the detergent level sensor 240 for sensing the remaining amount of detergent stored in the detergent container 280.

The output signal of the detergent level sensor 240 may be transmitted to the controller 100, and the controller 100 may easily identify the level and the remaining amount of detergent stored inside the container body 281 via the received output signal of the detergent level sensor 240. In this regard, when the remaining amount of detergent sensed via the detergent level sensor 240 is equal to or smaller than a predetermined amount, the controller 100 may control a visual alarm or an acoustic alarm containing information indicating that the remaining amount of detergent is insufficient to be generated via the display or a sound outputter 38.

In addition, the controller 100 may sense a level of the detergent at a time point at which the detergent supply is initiated and a level of the detergent at a time point at which the detergent supply is completed via the detergent level sensor 240, and effectively identify the viscosity of the detergent currently stored in the detergent container 280 based on the amount of change in the level of the detergent.

In one example, the controller 100 may be electrically connected to the detachment detection sensor 260 for sensing the detachment of the detergent container 280.

The output signal of the detachment detection sensor 260 may be transmitted to the controller 100, and the controller 100 may easily identify whether the detergent container 280 is mounted in the housing 210 or is removed from the housing 210 via the received output signal of the detachment detection sensor 260.

When determining that the detergent container 280 is removed, the controller 100 may control a visual alarm or an acoustic alarm containing information indicating that the detergent container 280 is not mounted to be generated via the display or the sound outputter 38.

In one example, the controller 100 is electrically connected to a memory and a timer. The controller 100 calls operation conditions, time conditions, and the like for each process pre-stored in the memory and uses the called conditions to generate a control signal for controlling progress and termination of the process. Furthermore, information regarding the supply amount (a preset amount) of the detergent to be supplied during the washing process may be further stored in the memory.

In addition, conversion data on the viscosity of the detergent corresponding to the amount of change in the level of the detergent between the level of the detergent at the time point at which the detergent supply is initiated and the level of the detergent at the time point at which the detergent supply is completed may be stored in the memory in a form of a conversion table.

Therefore, when the amount of change in the level is calculated, the controller 100 may call the pre-stored conversion data from the memory, determine the viscosity of the detergent corresponding to the calculated amount of change in the level, and determine the determined viscosity as a viscosity of the detergent currently stored in the detergent container 280. In other words, a density and the viscosity of the detergent may be determined considering that, when the density and the viscosity of the detergent are relatively great, a relatively great buoyancy may occur in the floater 250, and the great buoyancy may cause a great amount of change in the level via the floater 250.

Additionally, information regarding a washing process mode suitable for each viscosity of the detergent stored in the detergent container 280 may be stored in the memory.

The washing process mode may include a normal mode and a soft mode.

The soft mode may be a mode in which conditions of the washing process are partially changed to be suitable for the medium-viscosity detergent, compared to the normal mode. The partial change may include adjustment of a washing process time, adjustment of a pressure of the washing water sprayed via the spray arm, or adjustment of a temperature of the washing water.

In addition, the controller 100 may use the timer to calculate an elapsed time or the like for each process, compare the elapsed time with the pre-stored time conditions for each process, and determine whether to complete each process.

Additionally, the controller 100 is electrically connected to the display 33 and the sound outputter 38.

The controller 100 may control information regarding the operating state, an operating time, whether the process is complete, and the like of the dish washer 1 to be visually displayed via the display 33, and control an alarm regarding the operating state of the dish washer 1 or the completion of the process to be output as a voice or a sound via the above-described sound outputter 38 such as a buzzer or a speaker.

In addition, as will be described later, when it is determined that the viscosity of the detergent stored in the detergent container 280 is high, the controller 100 may control the display 33 or the sound outputter 38 such that a visual alarm containing information for inducing replacement of the detergent stored in the detergent container 280 with the low-viscosity detergent is output via the display 33 or a voice/sound alarm is output via the sound outputter 38.

Figure 14:
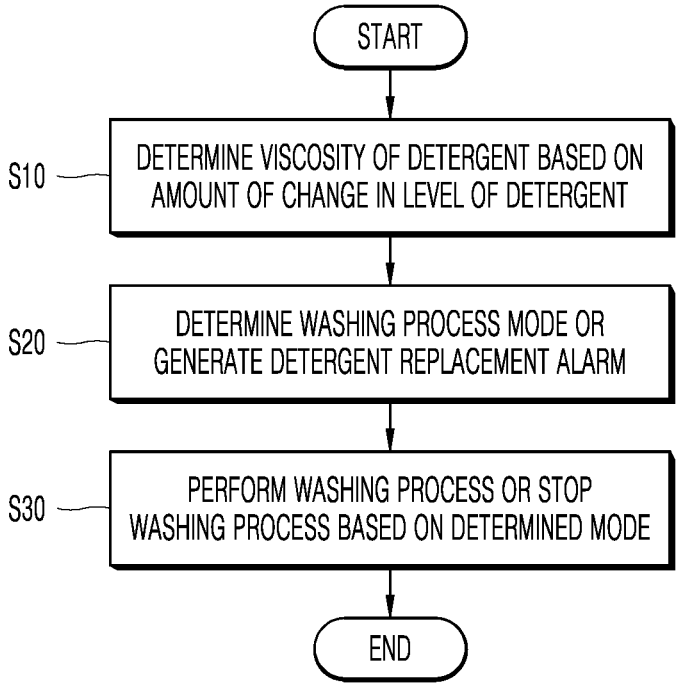
FIGS. 14 to 16 are flowcharts for illustrating control steps performed by a controller shown in FIG. 13.

Hereinafter, referring to FIGS. 14 to 16, a method S1 for controlling the dish washer 1 according to the present disclosure will be described.

As described above, the dish washer 1 according to the present disclosure is to receive the output signal from the detergent level sensor 240, calculate the amount of change in the level of the detergent sensed from the change in the received output signal, and identify the viscosity of the detergent currently stored in the detergent container 280 based on the calculated amount of change in the level.

To this end, the method S1 for controlling the dish washer 1 may include calculating (S10) the amount of change in the level by sensing the level of the detergent that changes based on the operation of the detergent pump via the detergent level sensor, and determining the viscosity of the detergent based on the calculated amount of change in the level, determining (S20) the washing process mode suitable for the viscosity of the detergent or generating the detergent replacement alarm based on the determined viscosity of the detergent, and performing (S30) the washing process or stopping the washing process based on the determined washing process mode.

Figure 15:
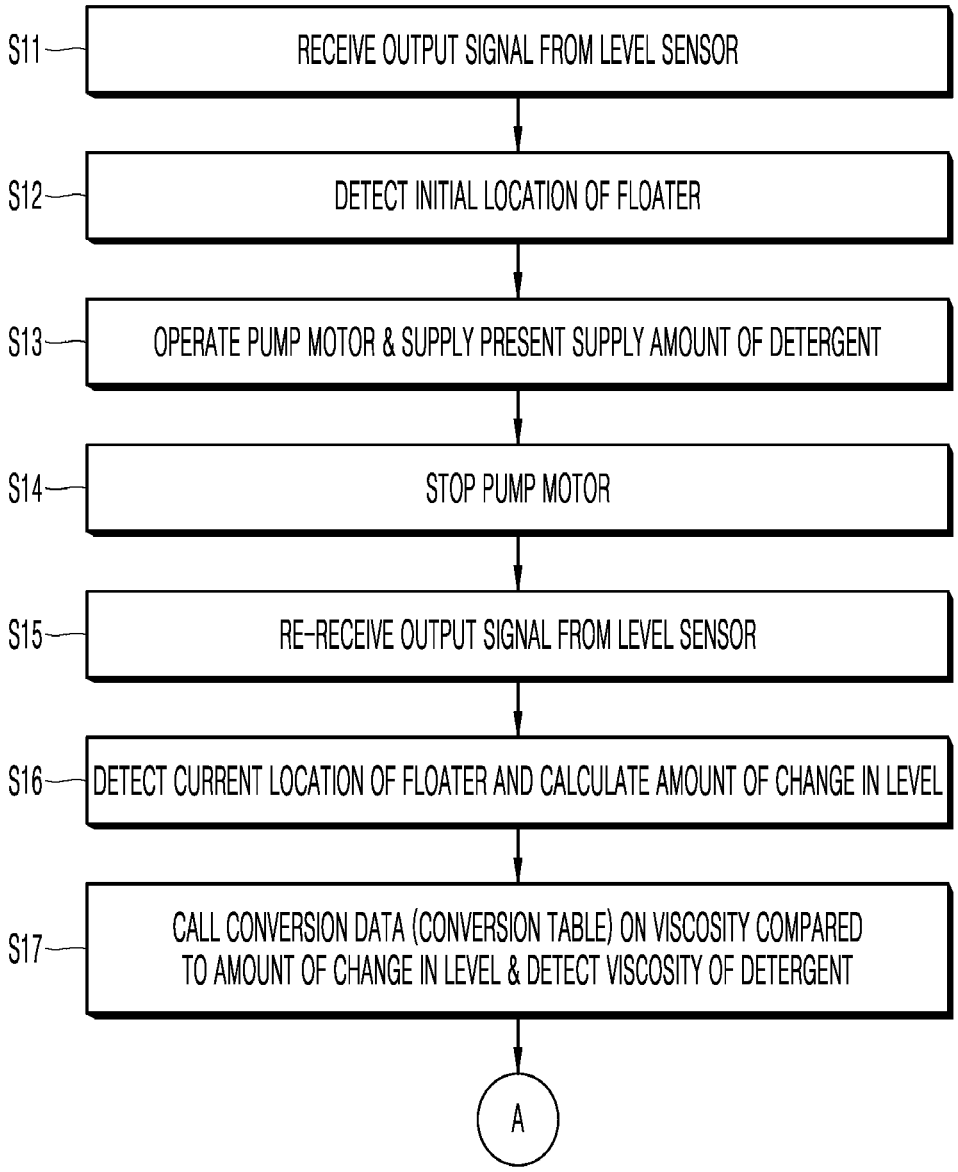

FIG. 15 shows detailed steps of the determining (S10) of the viscosity of the detergent.

Referring to FIG. 15, first, the controller 100 receives the output signal from the detergent level sensor 240 (S11).

When receiving the output signal from the detergent level sensor 240, the controller 100 detects an initial location of the floater 250 from the received output signal and stores the initial location in the memory (S12).

In this regard, the initial location of the floater 250 may be a location and a level of the detergent before the operation of the detergent pump 230 is initiated and the supply of the detergent progresses.

Preferably, the initial location of the floater 250 may be a location between the highest location in the vertical direction and the lowest location in the vertical direction described above. In other words, a location that is not affected by the stopper rib 2815*a*1 and the guide bar 2815*c*2 described above may be set as the initial location of the floater 250 such that an amount of change in the location of the floater 250 that changes depending on the detergent supply amount is effectively sensed.

In S12, when the detection of the initial location of the floater 250 is completed, to initiate the supply of the detergent, the controller 100 supplies the power to the pump motor 238 to operate the pump motor 238, and supplies the present supply amount of detergent to the tub 20 (S13).

In this regard, to supply the present supply amount of detergent, the controller 100 may calculate the number of revolutions of the roller 233 based on the output signal of the roller sensor 2391, and when it is determined that the number of revolutions has reached the set number, determine that the supply of the preset supply amount of the detergent has been completed.

Next, when the supply of the preset supply amount of the detergent is completed in S13, to stop the supply of the detergent, the controller 100 stops the power supply to the pump motor 238 to stop the pump motor 238 (S14).

Next, when the operation of the pump motor 238 is stopped in S14, the controller 100 re-receives the output signal from the detergent level sensor 240 to sense the current location of the floater 250 (S15).

When the output signal of the detergent level sensor 240 is re-received in S15, the controller 100 detects the current location of the floater 250 via the re-received output signal, and calculates the amount of change in the level of the detergent changed based on the supply of the detergent (S16).

In this regard, the amount of change in the level of the detergent may be calculated in a scheme of calculating a difference between the initial location of the floater 250 and the current location of the floater 250.

Next, when the amount of change in the level of the detergent is calculated, the controller 100 detects and determines the viscosity of the detergent based on the calculated amount of change in the level (S17).

In this regard, to detect the viscosity of the detergent, the controller 100 may call the conversion data on the viscosity compared to the amount of change in the level from the memory as described above, and determine the viscosity of the detergent in a scheme of reading the viscosity of the detergent corresponding to the called amount of change in the level.

Figure 16:
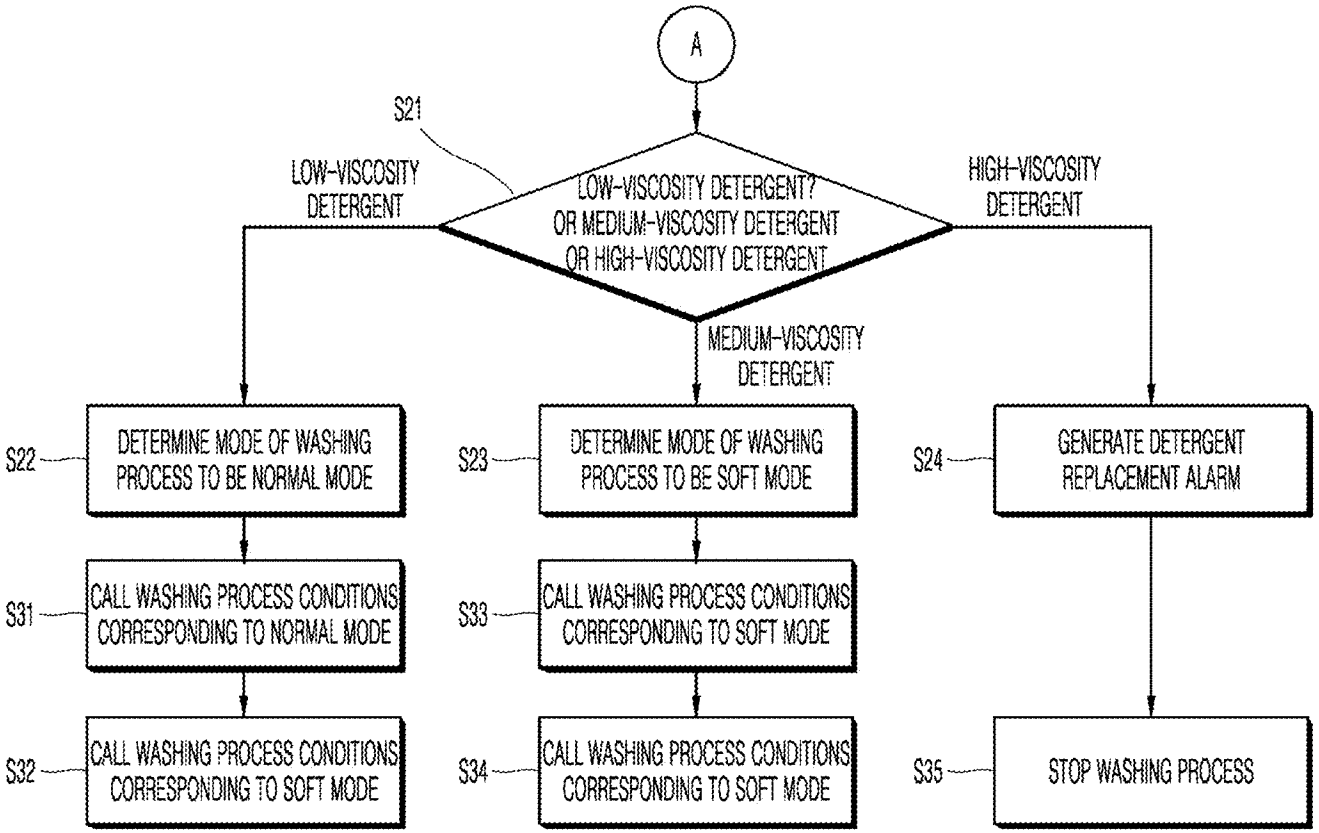

FIG. 16 shows detailed steps of the determining (S20) of the washing process mode suitable for the viscosity of the detergent or the generating of the detergent replacement alarm based on the determined viscosity of the detergent and the performing (S30) of the washing process or the stopping of the washing process based on the determined washing process mode.

Referring to FIG. 16, when the viscosity of the detergent is detected and determined in S17 described above, the controller 100 determines whether the determined viscosity of the detergent is low, medium, or high (S21).

When it is determined in S21 that the viscosity of the detergent is low, the controller 100 then determines a mode of a washing process suitable for the detergent currently stored in the detergent container 280 to be the normal mode (S22).

Accordingly, the controller 100 may call washing process conditions corresponding to the normal mode from the memory, and control the washing process to proceed later based on the called washing process conditions (S31 and S32).

When it is determined in S21 that the viscosity of the detergent is medium, the controller 100 determines the mode of the washing process to be the soft mode (S23).

Accordingly, the controller 100 may call washing process conditions corresponding to the soft mode from the memory, and control a remaining washing process to proceed based on the called washing process conditions (S33 and S34).

As mentioned above, the soft mode may be the mode in which the conditions of the washing process are partially changed to be suitable for the medium-viscosity detergent, compared to the normal mode. The partial change may include the adjustment of the washing process time, the adjustment of the pressure of the washing water sprayed via the spray arm, or the adjustment of the temperature of the washing water.

When it is determined in S21 that the viscosity of the detergent is high, the controller 100 may control the display 33 or the sound outputter 38 such that the visual alarm containing the information for inducing the replacement of the detergent stored in the detergent container 280 with the low-viscosity or medium-viscosity detergent is output via the display 33 or the voice/sound alarm is output via the sound outputter 38 (S24).

Via such detergent replacement alarm, the replacement of the detergent by the user may be effectively induced.

Furthermore, when it is determined in S21 that the viscosity of the detergent is high, the controller 100 determines to stop the washing process such that the washing process does not proceed thereafter (S35).

In other words, when the viscosity of the detergent currently stored in the detergent container 280 is high, such high-viscosity detergent may be unsuitable for the supply of the detergent via the detergent pump 230. Therefore, when it is determined that the detergent stored in the detergent container 280 is the unsuitable high-viscosity detergent, the controller 100 stops the remaining washing process to prevent damage to the detergent pump 230.

As such, the detergent supply 200 of the dish washer 1 according to the present disclosure may receive the output signal from the detergent level sensor 240, calculate the amount of change in the level of the detergent sensed from the change in the received output signal, and identify and determine the viscosity of the detergent currently stored in the detergent container 280 based on the calculated amount of change in the level. Accordingly, as described above, the separate electrode sensor or the like for sensing the viscosity of the detergent may be eliminated, which simplifies the structure, improves the space utilization, and reduces the manufacturing cost.

As described above, the present disclosure has been described with reference to illustrative drawings, but the present disclosure is not limited by the embodiments disclosed herein and the drawings, and it is obvious that various modifications may be made by those skilled in the art within the scope of the technical idea of the present disclosure. In addition, although effects of a component of the present disclosure were not explicitly described when describing the embodiment of the present disclosure above, it is natural that the predictable effects of the corresponding component should also be recognized.

What is claimed is:

1. A dish washer comprising:

a tub that defines a washing space therein;

a detergent supply comprising (i) a container configured to store detergent to be provided to the washing space and (ii) a detergent pump configured to supply the detergent in the container to the washing space; and a controller configured to control the detergent pump, wherein the container comprises:

a floater disposed inside the container and configured to move along a vertical direction based on a level of the detergent in the container, and a detergent level sensor configured to sense a vertical location of the floater in the vertical direction and to generate an output signal corresponding to the vertical location of the floater, and wherein the controller is configured to:

determine an amount of change of the level of the detergent in the container based on the detergent level sensor sensing the level of the detergent during operation of the detergent pump, and determine a viscosity of the detergent based on the amount of change of the level of the detergent.

2. The dish washer of claim 1, wherein the controller is configured to determine the viscosity of the detergent by operations comprising:

receiving a first output signal from the detergent level sensor;

detecting a first location of the floater based on the first output signal;

operating the detergent pump to supply a preset supply amount of the detergent to the tub based on the first location of the floater being detected;

receiving a second output signal from the detergent level sensor after supplying the preset supply amount of the detergent to the tub;

detecting a second location of the floater based on the second output signal;

determining the amount of change of the level of the detergent based on the first location of the floater and the second location of the floater; and detecting the viscosity of the detergent based on the amount of change of the level of the detergent.

3. The dish washer of claim 2, wherein the detergent pump comprises:

a tube configured to guide the detergent discharged from the container to the washing space;

a roller configured to pressurize the tube, the roller being configured to revolve about a revolution axis to thereby cause the detergent inside the tube to flow;

a pump motor configured to generate a driving force to move the roller; and a roller sensor configured to sense a location of the roller and to generate an output signal corresponding to the location of the roller, and wherein the controller is configured to:

determine a number of revolutions of the roller about the revolution axis based on the output signal of the roller sensor, and based on a determination that the number of revolutions of the roller has reached a set number, determine that the preset supply amount of the detergent has been supplied to the tub.

4. The dish washer of claim 2, wherein the controller is configured to determine the amount of change of the level of the detergent by calculating a difference between the first location of the floater and the second location of the floater.

5. The dish washer of claim 2, wherein the controller is configured to:

obtain, from a memory, data that correlate a plurality of amounts of change of the level of the detergent to a plurality of viscosity levels, respectively; and determine, from the data, one of the viscosity levels corresponding to the amount of change of the level.

6. The dish washer of claim 1, wherein the controller is configured to, based on the viscosity of the detergent, (i) determine a mode of a washing process corresponding to the viscosity of the detergent or (ii) generate a detergent replacement alarm.

7. The dish washer of claim 6, wherein the controller is configured to, based on determining whether the viscosity of the detergent corresponds to one of first, second, or third viscosity levels, (i) determine the mode of the washing process corresponding to the viscosity of the detergent or (ii) generate the detergent replacement alarm, and wherein the first viscosity level is less than the third viscosity level, and the second viscosity level is greater than the first viscosity level and less than the third viscosity level.

8. The dish washer of claim 7, wherein the controller is configured to determine the mode of the washing process to be a normal mode based on a determination that the viscosity of the detergent corresponds to the first viscosity level.

9. The dish washer of claim 7, wherein the controller is configured to determine the mode of the washing process to be a soft mode based on a determination that the viscosity of the detergent corresponds to the second viscosity level.

10. The dish washer of claim 7, wherein the controller is configured to generate a visual alarm via a display or an acoustic alarm via a sound outputter based on a determination that the viscosity of the detergent corresponds to the third viscosity level.

11. The dish washer of claim 10, wherein the visual alarm and the acoustic alarm comprise information indicating replacement of the detergent or that the detergent is not suitable for washing.

12. The dish washer of claim 10, wherein the controller is configured to stop the washing process based on a determination that the viscosity of the detergent corresponds to the third viscosity level.

* * * * *